US007063647B2

(12) United States Patent
Harney et al.

(10) Patent No.: US 7,063,647 B2
(45) Date of Patent: Jun. 20, 2006

(54) AUTOMATED PHYSICAL TRAINING SYSTEM

(75) Inventors: Randy Harney, St. Paul, MN (US); Ryan Fuchs, Hopkins, MN (US)

(73) Assignee: P.A. Interactive, LLC, St. Louis Park, MN (US)

( * ) Notice: Subject to any disclaimer, the term of this patent is extended or adjusted under 35 U.S.C. 154(b) by 400 days.

(21) Appl. No.: 10/210,507

(22) Filed: Aug. 1, 2002

(65) Prior Publication Data

US 2003/0013584 A1 Jan. 16, 2003

Related U.S. Application Data

(63) Continuation-in-part of application No. 09/794,775, filed on Feb. 27, 2001, now Pat. No. 6,575,879.

(60) Provisional application No. 60/193,316, filed on Mar. 30, 2000, provisional application No. 60/309,316, filed on Aug. 1, 2001.

(51) Int. Cl.
*A63B 22/00* (2006.01)

(52) U.S. Cl. ..... 482/54; 482/1; 482/4; 482/86; 473/441

(58) Field of Classification Search ..... 482/1–9, 482/51, 54, 900–902, 83, 84, 86; 273/440, 273/440.1, 441, 454; 473/415, 422, 438, 473/441–445

See application file for complete search history.

(56) References Cited

U.S. PATENT DOCUMENTS

| | | | | |
|---|---|---|---|---|
| 4,534,557 | A | 8/1985 | Bigelow | |
| 4,890,495 | A | 1/1990 | Slane | |
| 5,152,733 | A | 10/1992 | Farenholtz | |
| 5,474,290 | A | 12/1995 | Rascona | |
| 5,655,997 | A | 8/1997 | Greenberg et al. | |
| 5,785,632 | A | 7/1998 | Greenberg et al. | |
| 6,093,119 | A | 7/2000 | Tipton | |
| 6,387,015 | B1 * | 5/2002 | Watson | 482/54 |
| 6,454,679 | B1 * | 9/2002 | Radow | 482/4 |

FOREIGN PATENT DOCUMENTS

WO WO 87/05727 9/1987

OTHER PUBLICATIONS

"Dynamonster" Videotape, American Creative Products, Inc.

Lakomy, *An Ergomether for Measuring the Power Generated During Sprinting, Physiological Society,* Apr. 1984, pp. 33P.

Lakomy, *The Use of a Non-motorized Treadmill for Analysing Spring Performance, Ergonomics,* 1987, vol. 30, No. 4, pp. 627-637.

(Continued)

*Primary Examiner*—Glenn E. Richman
(74) *Attorney, Agent, or Firm*—Patterson, Thuente, Skaar & Christensen, P.A.

(57) ABSTRACT

The present invention is a system for automatically controlling and assessing a user athlete's physical training prowess at certain athletic skills. An apparatus of the present invention can be a treadmill sled having a frame, a rotatable continuous belt mounted on the frame, the belt presenting an upward directed support surface for supporting a user athlete, a training apparatus, and a performance measuring system. The training apparatus can include a blocking dummy and support frame, or a tether frame support system. Further, the performance measuring system can include programmable and automated control of the timing, duration, and scope/level of the physical training, and present quantitative assessment feedback to better maximize the applicable training regime, and to simplify the training sessions for supervisory personnel as well as the participating athlete(s).

22 Claims, 26 Drawing Sheets

OTHER PUBLICATIONS

Edited by John A. Hawley, *Physiology and Biochemistry of Sprinting, Running,* Chapter 1, pp. 1-13.

A. Jaskólska, *Comparison of Treadmill and Cycle Ergometer Measurements of Force-Velocity Relationships and Power Output, Int J Sports Med,* 1999, pp. 192-197.

K. Funato et al., *Ergometry for Estimation of Mechanical Power Output in Sprinting in Humans Using a Newly Developed Self-driven Treadmill, Eur J Appl Physiol,* 2001, pp. 169-173.

R. Kram et al., *Force Treadmill for Measuring Vertical and Horizontal Ground Reaction Forces, American Physiological Society,* 1998, pp. 764-769.

A. Jaskólska, *Optimal Resistance for Maximal Power During Treadmill Running*, Sports Med, Training and Rehab,* 1996, vol. 7, pp. 17-30.

S.M. Chelly, *Leg Power and Hopping Stiffness: Relationship With Spring Running Performance, Medicine & Science in Sports & Excerise,* 2001, pp. 326-333.

* cited by examiner

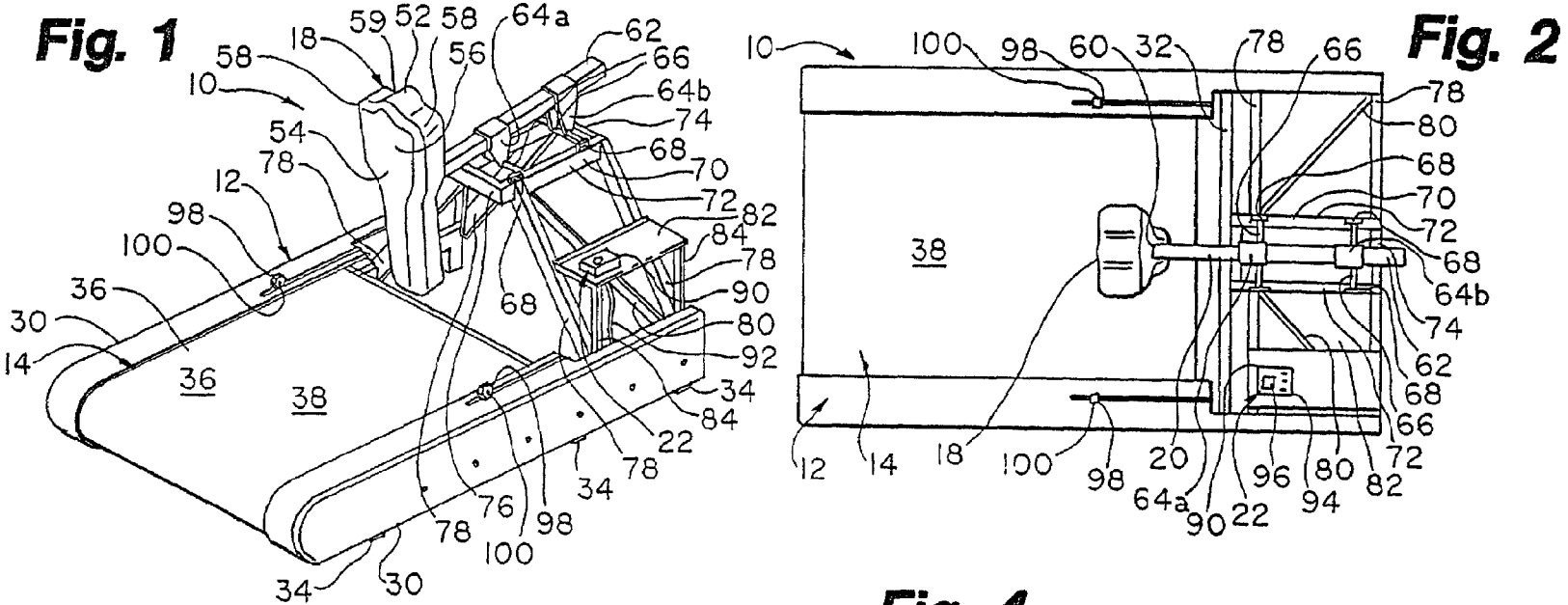
Fig. 2
Fig. 1
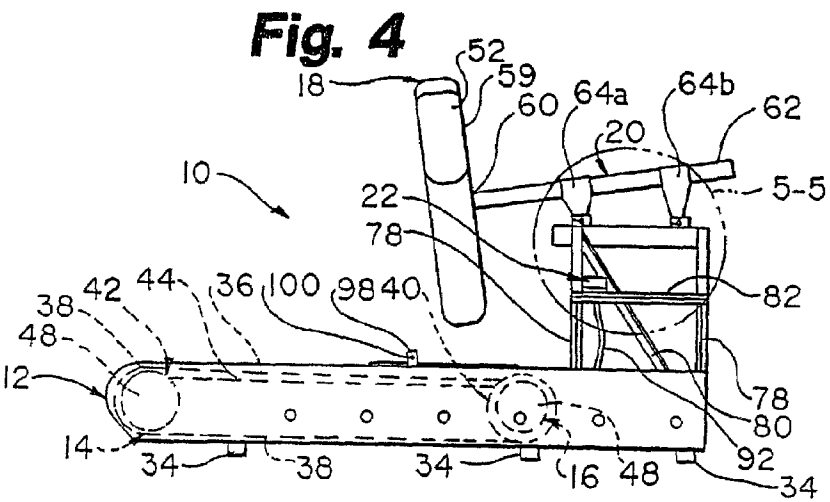
Fig. 4
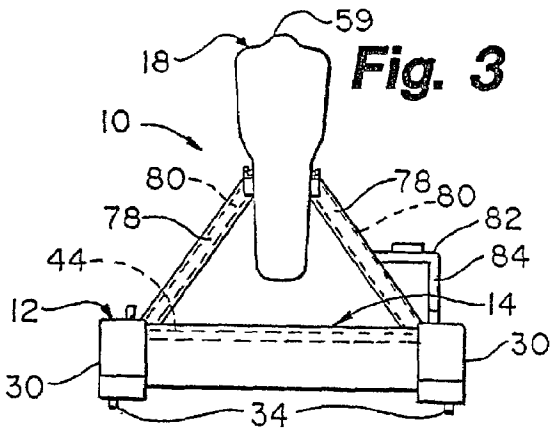
Fig. 3

DISPLACEMENT/TIME= VELOCITY
FORCE (X) x VELOCITY = POWER
X/TOTAL FORCE = PERCENT FROM X
1 + 2 = TOTAL DISPLACEMENT
X + Y = TOTAL FORCE
1) CALIBRATION INPUT, 2) ANALOG INPUT TO DIGITAL OUTPUT, 3) UNIT CONVERSION
RESPONSE TIME - REACTION TIME = MOVEMENT TIME
A
B
C
D
E
F
G
H
I
J
K
L
M
N
O
P
Q
R
S 10
12
14
18
30
48, 50
34
38
36
58
52
54
56
170
20
62
168
51
16
22
163
172
96
40
30

AUTOMATED PHYSICAL TRAINING SYSTEM

RELATED APPLICATIONS

The present invention is a continuation-in-part of co-pending U.S. patent application Ser. No. 09/794,775, filed Feb. 27, 2001, now U.S. Pat. No. 6,575,879, which claims priority to U.S. Provisional Patent Application 60/193,316, filed Mar. 30, 2000; and this continuation-in-part claims priority to U.S. Provisional Patent Application 60/309,316, filed Aug. 1, 2001; each of the referenced Applications are incorporated herein by reference.

TECHNICAL FIELD

The present invention relates to a method and apparatus for assessing a user athlete. More particularly, the present invention relates to a physical training system employing automatic control, measurement, and assessment of at least one user athlete's performance.

BACKGROUND OF THE INVENTION

Football

The skills that are important to a successful performance in the game of American football include blocking, charging, tackling, sprinting and pass blocking. Current methods of evaluating these skills include qualitative assessments by coaches while using blocking and tackling sleds on the playing field and quantitative assessments such as the bench press, back squat, power clean and vertical jump in the gymnasium. The coaches' assessments on the playing field are not accurate due to changes in the environment, differences between observers, and the fact that these measurements are purely qualitative, while the quantitative measurements in the gymnasium are not accurate due to their non-specific nature, in that the movements are very different from the skills performed on the playing field. Therefore, it would be beneficial to develop a testing device that could simulate the resistive force of an opposing player, while accurately measuring performance when blocking, charging, tackling and pass blocking. In doing so, it would provide a more precise and reflective measure of an athlete's physical potential on the playing field and provide quantitative information that can be used when making decisions about training.

Skills that need to be evaluated include:

1. Charging. A strategic maneuver used by the defensive team to keep the offensive team from gaining yardage and scoring points. Also, strategic maneuver used by the ball carrier to gain yardage and score points.
2. Blocking. A strategic maneuver used by the offensive team to keep the defensive team away from the player carrying the ball.
3. Tackling. A strategic maneuver used by the defensive team to keep the offensive ball carrier from gaining yardage and scoring points.
4. Pass blocking. A strategic maneuver used by the offensive team to keep the defensive team away from the player passing the ball.

Anaerobic Type Activities

The physical abilities that are important in anaerobic type sports and other physical jobs such as firefighting and law enforcement include anaerobic strength, power, acceleration, speed, agility, and short term muscular endurance. For sports activities, it is generally necessary to perform off-season training programs such as:

1. Task specific activities that improve the above physical abilities.
2. Motivational strategies that encourage users to work to the best of their ability by encouraging competition.
3. Organizational strategies that are designed to allow users to complete the activities in the shortest period of time—or the most-efficient time period.
4. Organizational strategies that allow a large number of users to participate with minimal personnel supervision.
5. Training devices that take up very little space in a designated training facility.

Conventional off-season training methods and techniques include weight lifting, jump training, sprint training, agility training, and the like. Each training regimen often requires extensive training supervision. As such, much of the efficiency and individualistic training focus is lost or even avoided. Limited personnel, unskilled personnel, and cost and time restraints make effective off-season training ineffective. Each training regimen is generally segregated and conducted without looking at the effects to, or an integration with, other training regimens. Further, without the proper implementation and timing for the individual training tasks, athletes are unable to properly focus the workouts in a manner that serves to maximize the individual's needs against the goals of the specific regimen (i.e., timing, strength, jumping, etc.) or the aggregate regimem schedule.

As a result, an automated physical training system is needed that will address many of the deficiencies present with conventional techniques, systems, and methods of training. Specifically, there is a need to address the present problems with systems that are unable and ill equipped to control the scope and timing of the training sessions. Further, there is a need to address the weaknesses with typical segregated approaches to training such that an automated system can better integrate training programs in a manner that will improve training control, efficiency, and overall athletic assessment.

SUMMARY OF THE INVENTION

The treadmill sled of the present invention substantially meets the aforementioned needs by providing an automated physical training device with programmable control over the scope and timing of the physical training. Moreover, the present invention provides a system that better serves to integrate and control training sessions over a broad multi-purpose training program.

In one embodiment, repeatable quantitative results measure charging, blocking, tackling and pass blocking analysis of an athlete. In order to make such analysis, the treadmill sled of the present invention measures at least some or all of the following parameters:

1. Direction of force application.
2. Position of force application.
3. Instantaneous magnitude of force.
4. Displacement of the treadmill and the spring compensated blocking dummy.
5. Instantaneous magnitude of power output (force times distance divided by time).
6. Reaction time (the duration of time between the stimulus and the player movement).
7. Movement time (the duration of time between the player's movement and contact with an opposing object).

There is a certain rationale for measuring the above-noted quantities. With respect to the direction of force application, it is noted that when blocking, charging and pass blocking, it is advantageous to apply force in a horizontal direction (X) in the horizontal (X, Y) plane. Any force in the vertical direction (Z) will not contribute to moving the opposing player backward. Therefore, measuring the direction of the force application will determine whether changes need to be made to the block, charge, or pass blocking technique of the athlete to increase the force applied in the X direction. In addition, the force applied by the right and left hands of the athlete (such force having a component in the Y direction) may provide information about left or right dominance by either side. A weakness in one side may provide the opponent with an advantage. Measuring the amplitude of left and right force production (such force production having a component in the Y direction) will identify these weaknesses so that adjustments can be made during training of the athlete.

With respect to the measurement of position of force application, it is advantageous to apply force in the center of an opponent's mass while blocking, charging, and pass blocking. If a block or charge is applied too high on the opponent, the opponent may duck below the attempted force application and avoid being moved in the desired direction. In addition, the higher the position of force application, the greater percentage of the forces will be applied in the vertical (Z) direction as a result of the body's angle. On tackling an opposing player, it is advantageous to apply force below the center of the opponent's mass. This causes the opposing player to rotate around the player's center of mass and potentially fall to the ground. Measuring the position of force application identifies errors while performing the force application so that adjustments can be made during the athlete's training.

With respect to measuring instantaneous magnitude of force, it is advantageous to apply maximal forces through the duration of the block, charge, pass block and tackle. If the applied forces are reduced at any time, the opponent may be able to resist or avoid being moved in the desired direction. Measuring the magnitude of the force application identifies fluctuations while performing the particular maneuver so that adjustments can be made to the skill of the athlete during training.

An embodiment of the treadmill sled of the present invention further measures displacement of the treadmill and the spring compensated pad. In an isotonic mode, the belt of the treadmill and the spring of the pad mount are displaced by the forces applied by the feet and hands of the athlete. The rate at which the belt and pad are displaced depends on the amount of the opposing force provided by the treadmill braking system and the spring. Further, the amplitude and frequency of the force applied by the athlete's lever system further affects the rate. It is advantageous to displace the belt on the spring the greatest distance in the shortest period of time. The treadmill provides unlimited distance for which to block, charge, pass block or tackle. As a result, an athlete can be tested for short distances or long distances depending on the distances normally covered on the playing field.

A further measurement is the instantaneous magnitude of power output. It is advantageous to produce large and consistent power outputs while blocking, tackling, pass blocking and charging opposing players. Functional power during these skills is recorded as product of force in the X direction and displacement of the treadmill belt and blocking pad, divided by the time of execution. The amplitude of this power throughout the duration of the maneuver provides values such as impact power, maximum power, minimum power, and reduction in power from the maximum value over the time of the maneuver. These measurements are valuable in determining those athletes who are successful in these skills as opposed to those who are not so that adjustments may be made to improve certain aspects of a particular athlete's skills during training. Total power during these maneuvers is recorded as a product of force in all directions, displacement of both the treadmill and the blocking pad, divided by the time of execution of the maneuver. By measuring this quantity, the efficiency of the athlete's skill can be calculated. Efficiency is the product of functional power divided by the total power.

The device of the present invention further measures reaction time. It is advantageous to begin movement toward an opposing player in the shortest amount of time possible after the auditory or visual stimulus indicating initiation of contact. Players with shorter reaction times potentially make contact with their opponents at higher velocities, thereby resulting in greater power outputs directed to the opponent.

Additionally, it is desirable to measure movement time. It is advantageous to cover greater distances in shorter periods of time before making contact with the opponent while blocking, charging, and tackling. Players with shorter movement times potentially make contact with an opponent at higher velocities resulting in greater power outputs. Deficiencies noted in movement time can be corrected through changes in the skill technique of the player and in practicing the skill.

The present invention is a system for automatically controlling and assessing a user athlete's physical training prowess at certain athletic skills. An apparatus of the present invention can be a treadmill sled having a frame, a rotatable continuous belt mounted on the frame, the belt presenting an upward directed support surface for supporting a user athlete, a training apparatus supported proximate the continuous belt and being operably coupled to the frame, and a performance measuring system. In one embodiment, the training apparatus can be in the form of a blocking dummy operably coupled to the frame with a dummy support. In another embodiment, the training apparatus can be a support beam system to facilitate securement of a looped tether strap support. Further, the performance measuring system can include programmable and automated control of the timing, duration, and scope/level of the physical training, to present quantitative assessment feedback to better maximize the applicable training regimen, and to simplify the training sessions for supervisory personnel as well as the participating athlete(s). Various modes, such as blocking/tackling and sprinting, are selected and repetitions, start sequences, and resting periods are allocated and controlled to provide for a user-unique training session. Feedback and assessment data can be made available as display or storage output signals for review at the system, for inputting into other systems, or for supervisory monitoring at remote locations.

Sprinting embodiments of the present invention can include a looped tether strap removably securable and capable of looping around a user athlete to restrict the forward movement of the athlete during a sprint training regimen. The end of the tether strap opposite the user athlete receiving end is securable around the blocking dummy. Alternatively, the strap can be fastened to a modified treadmill sled having a strap support beam system. In each embodiment, the user initiates and advances simulated sprinting on the belt. The automated control and assessment system controls the timing, and provides feedback data such as distance traveled.

BRIEF DESCRIPTION OF THE DRAWINGS

FIG. 1 is a perspective view of a first embodiment of the blocking sled of the present invention;

FIG. 2 is a top plan form view of the blocking sled;

FIG. 3 is an elevational view of the blocking sled looking toward the contact surface of the blocking dummy;

FIG. 4 is a side elevational view of the blocking sled;

DETAILED DESCRIPTION OF THE DRAWINGS

Figure 5:
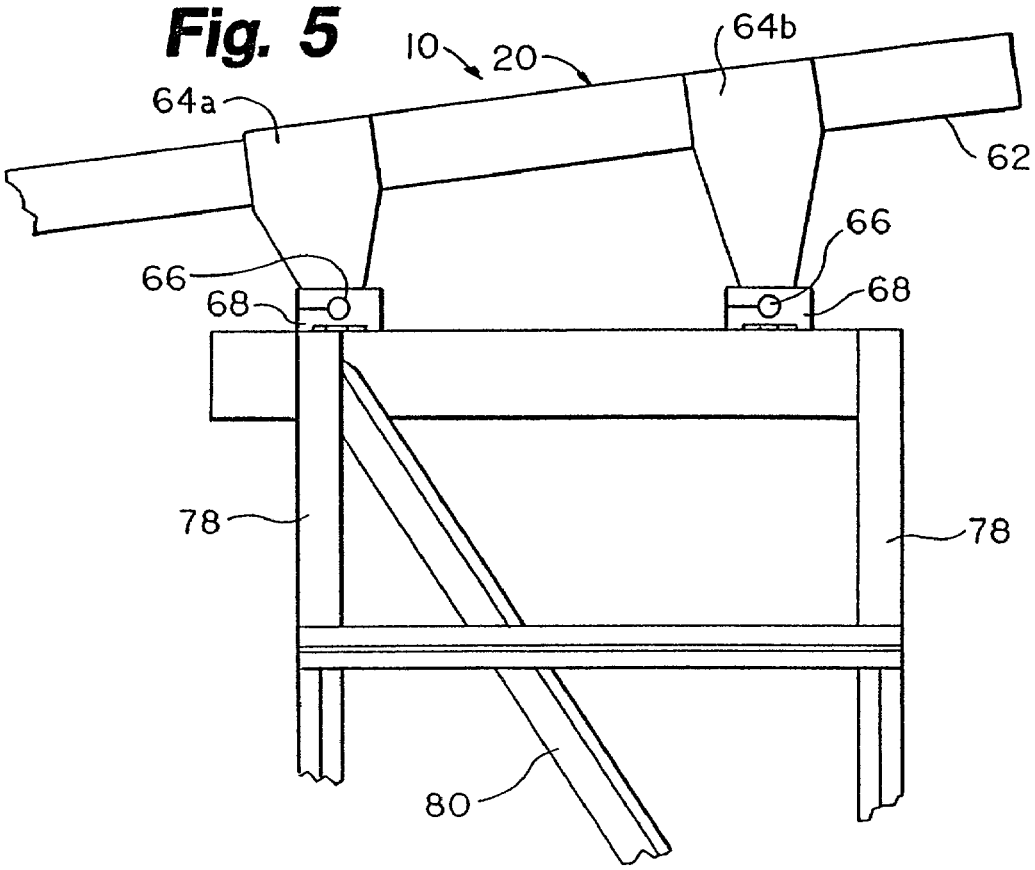
FIG. 5 is a side prospective view of common attachment points taken along the circle 5—5 of FIG. 4.
Figure 6:
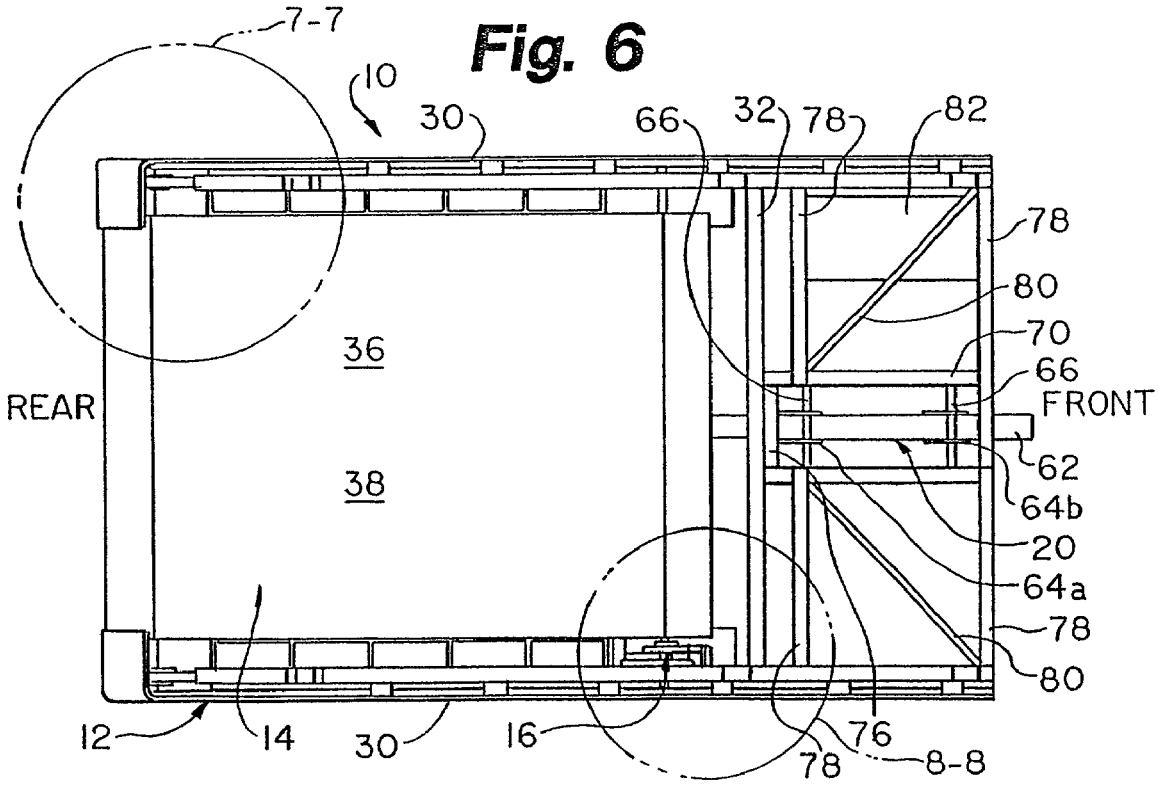
FIG. 6 is a bottom plan form view of the blocking sled.

The treadmill sled of the present invention is shown generally at 10. In each of the embodiments, the treadmill sled 10 generally includes the following major components:

A frame 12, a treadmill 14, a treadmill control system 16, a training apparatus 17, and a performance measurement system 22. The training apparatus 17 can take the shape of a blocking dummy 18 attached to the frame 12 by a dummy support 20, as described herein. In at least one embodiment, the training apparatus 17 can take the shape of a tether support frame system, as described herein. As will be described further, preferred embodiments of the performance measurement system 22 will include an automated control and assessment system 210. In each of the relevant embodiments of the treadmill sled 10, common components will be referred to with like numerals.

A first embodiment of the treadmill sled 10 is depicted in FIGS. 1–8. The frame 12 of the treadmill sled 10 has a pair of spaced apart, generally parallel side supports 30 that extend from the front to the rear of the treadmill sled 10. The side supports 30 are fixedly coupled together by a plurality of lateral supports 32 that extend between the two spaced apart sides supports 30 and are fixedly coupled thereto. A plurality of downward directed pads 34 are provided at the lower margin of the side supports 30 for engaging the surface on which the treadmill sled 10 is supported. The pads 34 are most useful when the treadmill sled 10 is disposed within a building and resting on a floor as distinct from being positioned on a practice field on a soil or other underlying surface.

The treadmill 14 of the treadmill sled 10 includes a continuous belt 36. The continuous belt 36 has an upward directed support surface 38 as depicted in FIGS. 1 and 2. The support surface 38 is directed downward on the return leg of the continuous belt 36 as viewed from the underside of the treadmill sled 10 in the depiction of FIG. 6.

Figure 30:
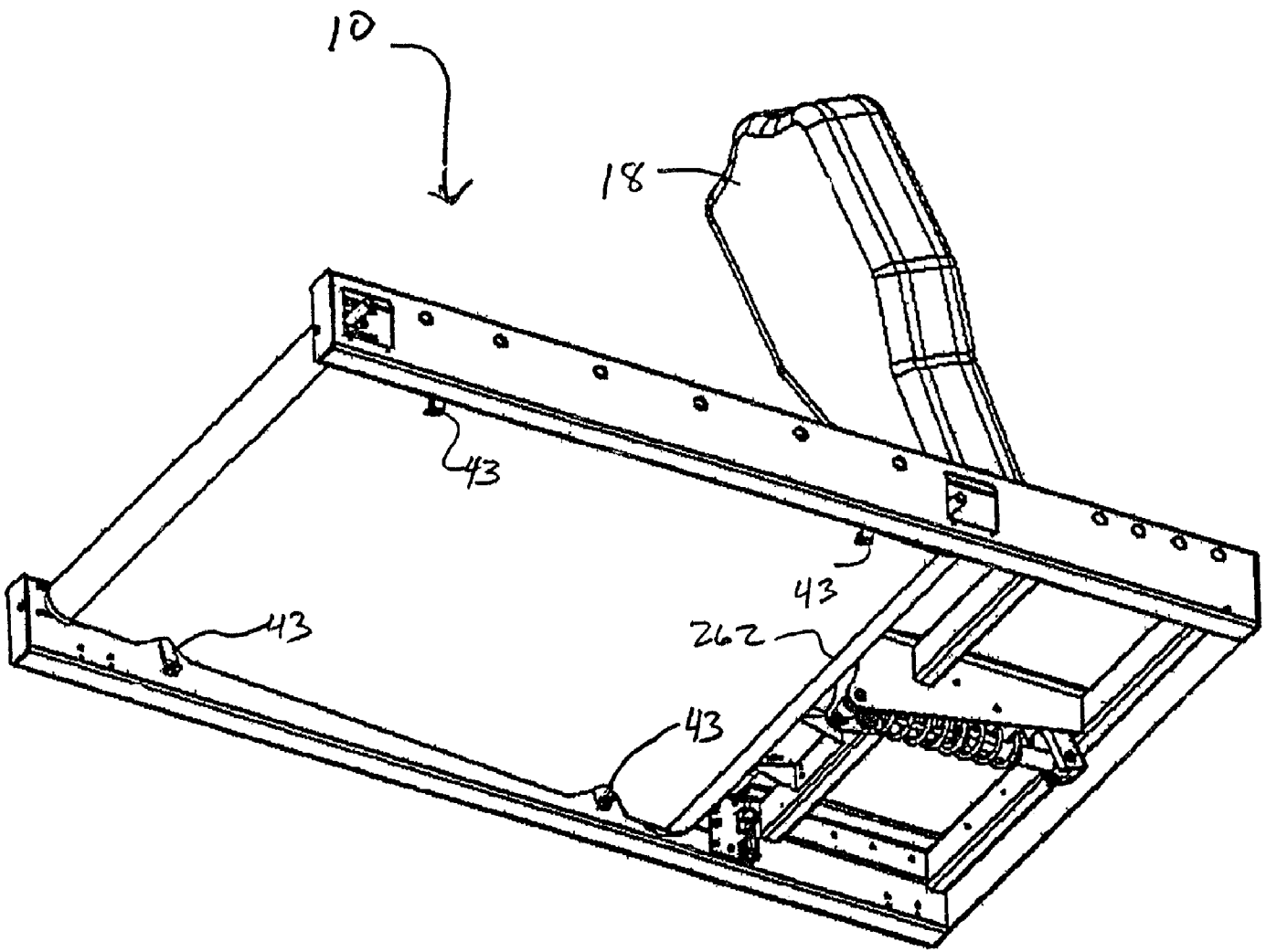
FIG. 30 is a perspective view of the underside of an embodiment of the present invention.

The continuous belt 36 is supported at least on a first roller 40 and a spaced apart second roller 42. Each of the rollers 40, 42 is supported on a roller axle 46, the roller axle 46 being borne in suitable bushings and being operably coupled to the respective side supports 30. An underlayment support 44 may be positioned immediately beneath the underside of the advancing portion of the continuous belt 36 to assist in supporting an athlete on the continuous belt 36. In practice, the continuous belt 36 slides across the upward directed surface of the underlayment support 44 when the continuous belt is rotated about the rollers 40, 42. The underlayment support 44 is depicted in phantom in FIGS. 3 and 4. The rollers 40,42 can take on a general crown shape, wherein the diameter increases toward the center to keep the belt 36 tracking in the center of the rollers despite lateral movement by the user. In addition, a plurality of vertical rollers 43 can be placed between the edge of the belt 36 and the inside surface of the frame 12 to keep the belt tracking in the center of the roller during use, as shown in FIG. 30.

The third component of the treadmill sled 10 is the treadmill control system 16. The treadmill control system 16 is best viewed in FIGS. 6–8. The treadmill control system 16 can include a disk brake 48 mounted on the axle 46 of the first roller 40. The disk brake 48 has a variable caliper 50 that is variably engageable with the disk brake 48. The variable caliper 50 may be manually adjusted in order to increase or decrease the amount of resistance that the first roller 40 transmits through the rotatability of the continuous belt 36. Accordingly, increasing the tension that the variable caliper 50 exerts upon the disk brake 48 directly effects the amount of driving effort that an athlete must impart to the continuous belt 36 in order to cause the continuous belt 36 to rotate about the rollers 40, 42.

Figure 7:
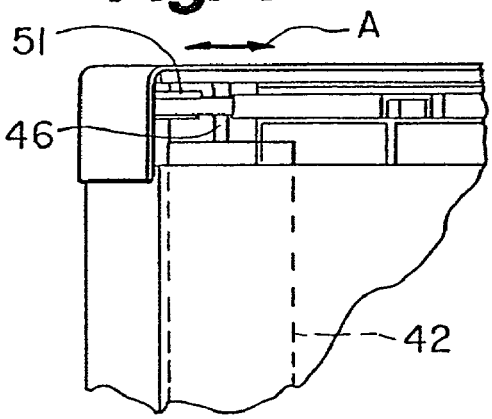
FIG. 7 is a bottom plan form of the belt tension adjustment as depicted in the circle 7—7 of FIG. 6.
Figure 8:
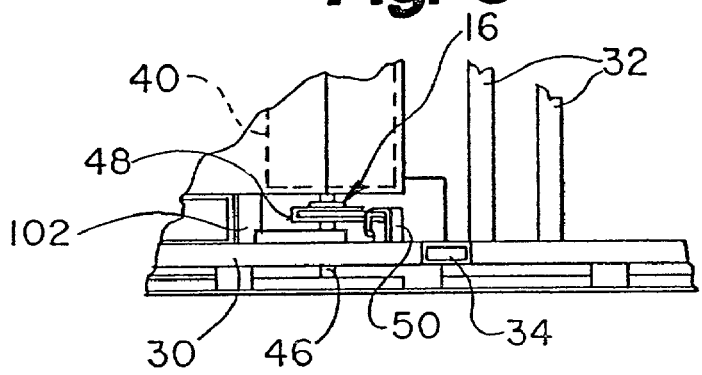
FIG. 8 is a bottom plan form view of the belt brake as depicted in the circle 8—8 of FIG. 6.

A threaded tension adjuster 51 can be operably coupled to the roller axle 46 of the second roller 42. Tension adjuster 51 directly effects the fore and aft disposition of the roller axle 46 relative to the frame 12. By rotating the threaded tension adjuster 51, the roller axle 46 of the second roller 42 is moved as depicted by arrow A of FIG. 7. Moving the rolling axle 46 rearward (leftward) as depicted in FIG. 7 acts to increase the distance between the rollers 40, 42, thereby increasing the tension on the continuous belt 36.

The fourth component of blocking/tackling embodiments of the treadmill sled 10 can include the blocking dummy 18. The blocking dummy 18 may be a conventional blocking dummy having a canvass exterior enclosing a resilient foam interior. The blocking dummy 18 has an impact body 52. The impact body 52 presents a rearward facing contact surface 54. The contact surface 54 can be shaped in the shape of an opposing athlete, having a torso 56 and shoulders 58. Other shapes of the impact body 52 may also be used, for example, a generally vertically disposed tubular body or a generally horizontally disposed tubular body. The impact body 52 may be mounted on a planar support 59. The planar support 59 may have an outer margin that is roughly the shape of the side margin of the impact body 52.

The fifth component of blocking/tackling embodiments of the treadmill sled 10 is the dummy support 20. The dummy support 20 of the present embodiment of the treadmill sled 10 can include an elongate beam 62. The beam 62 is fixedly coupled at the distal end by a single point attachment 60 to the planar support 59 of the blocking dummy.

The beam 62 has a pair of depending brackets 64*a*, 64*b*. The bracket 64*a* is more rearwardly disposed than the bracket 64*b* and has a lesser height dimension than the bracket 64*b*. The variance in height dimension of the brackets 64*a*, 64*b* effects an incline in the beam 62, the incline declining in a rearward direction toward the distal end of the beam 62. The brackets 64*a*, 64*b* are fixedly removably coupled to respective spaced apart receivers 68 by cross pins 66 that pass through bores defined in a respective pair of receivers 68 and a respective bracket 64*a*, 64*b*. The two pairs of receivers 68 are mounted on a box frame.

The box frame 70 includes a pair of spaced apart and generally parallel side rails 72. The side rails 72 are operably coupled together by an end rail 74 and a front rail 76 to define the generally rectangular shape of the box frame 70. There are two of the receivers 68 disposed on each of the two side rails 72.

Four angular supports 78 can rise to support the box frame 70. A first end of each of the angular supports 78 is coupled to a respective side support 30 at a second end of each of the angular supports 78 is fixedly coupled to the box frame 70. A pair of braces 80 rise to the box frame 70 to counter the force exerted by an athlete on the blocking dummy 18. A first end of each of the braces is fixedly coupled to a respective side support 30 proximate the front margin of the respective side support 30. Each of the braces 80 rise to a point proximate the point of connection of the rearwardmost angular support 78 with the box frame 70 and are fixedly connected to the box frame 70 proximate such point of connection.

A tray 82 can be disposed on a side of the dummy support 20. The tray 82 is supported at an outer margin by a pair of depending tray legs 84. The lower margin of the tray legs 84 is affixed to the upper margin of a side support 30.

The final major element of the treadmill sled 10 is the performance measurement system 22. In its simplest form in the embodiment of FIGS. 1–8, the performance measurement system 22 includes a controller 90 disposed on the upward directed surface of the tray 82. The controller 90 may be connected by a plurality of depending leads 92 to a plurality of sensors, as will be described. The controller 90 includes actuating switches 94 and a readout 96.

In the embodiment of FIGS. 1–8, the treadmill sled 10 has three sensors utilized for evaluating the performance of an athlete using the treadmill sled 10. First, the variable caliper 50 can be utilized to apply friction to the disk brake 48 to increase or decrease the resistance to motion that is available in continuous belt 36. In conjunction with that, a laser beam 98 can be included to provide an output related to the position of the using athlete's hands when in contact with the contact surface 54 of the impact body 52. A photoelectric cell 100 indicates when the user athlete's hands have commenced contact with the impact body 52. When used in conjunction with an auditory command given simultaneously with electing initiation of a timer with an actuating switch 94, the photoelectric cell 100 gives an indication of the reaction of the user athlete.

A further sensor can comprise a rotary encoder 102. The rotary encoder 102 is in contact with the continuous belt 36 and provides an output to the readout 96 that is indicative of the distance traveled by the continuous belt 36 during the blocking maneuver executed by the using athlete.

Figure 9:
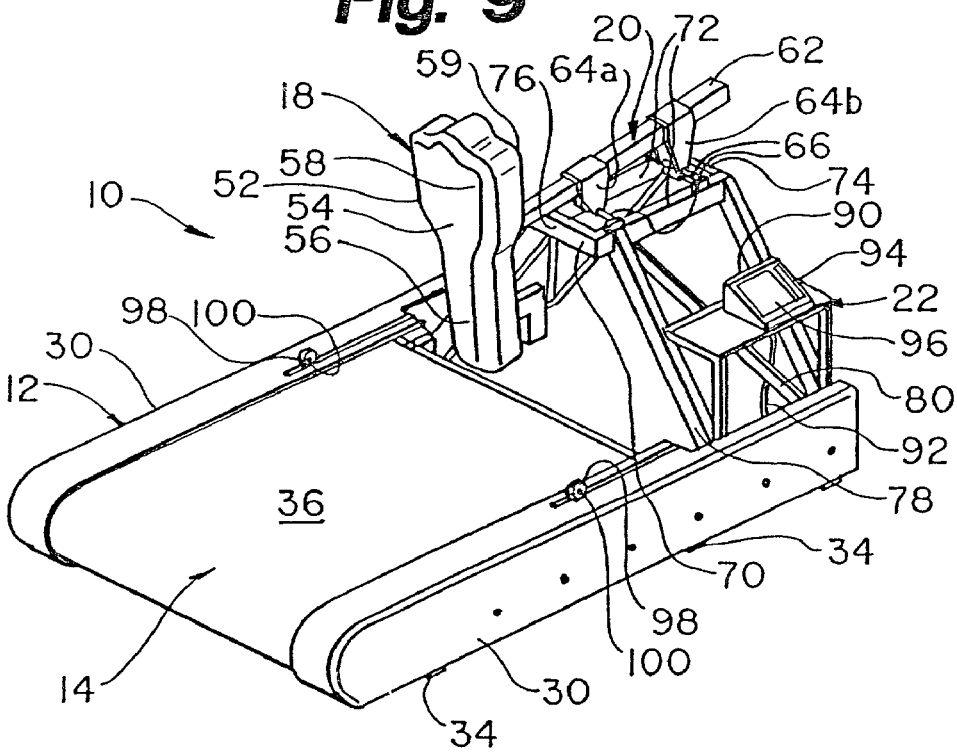
FIG. 9 is a perspective view of a second embodiment of the blocking sled of the present invention.
Figure 11:
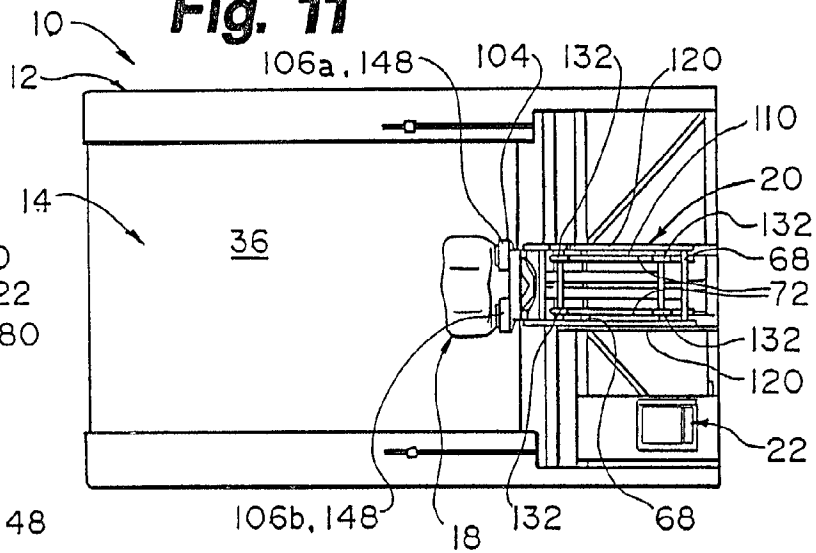
FIG. 11 is a top plan form view of the embodiment of FIG. 10.
Figure 13:
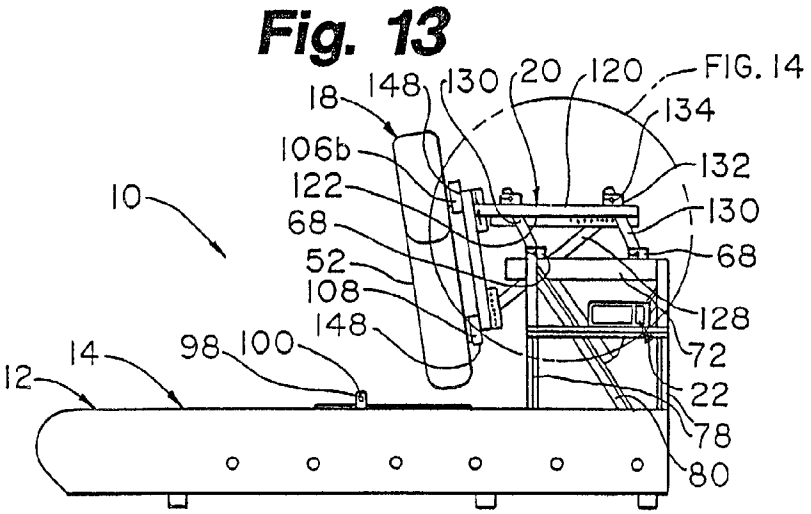
FIG. 13 is a side elevational view of the embodiment of FIG. 10.
Figure 10:
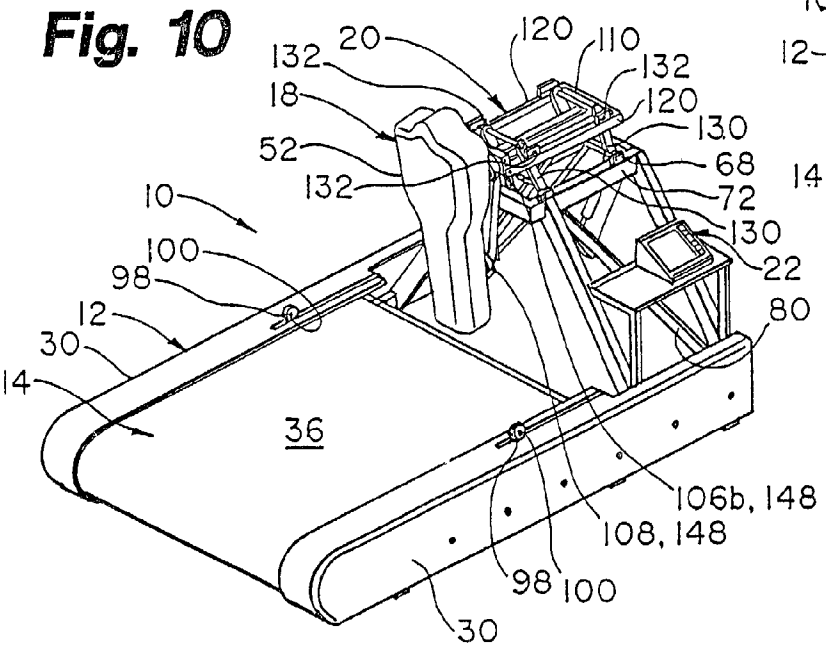
FIG. 10 is a perspective view of a third embodiment of the present invention.
Figure 12:
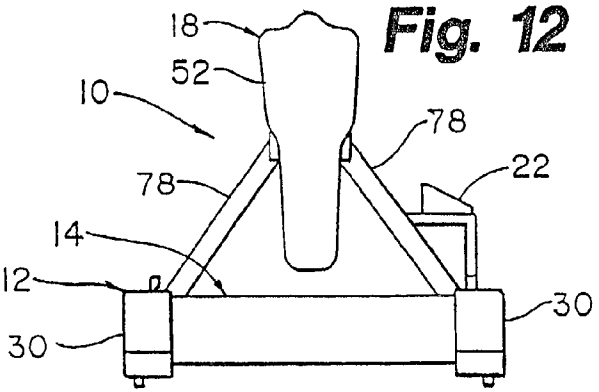
FIG. 12 is an end elevational view taken facing the blocking surface of the blocking dummy.
Figure 14:
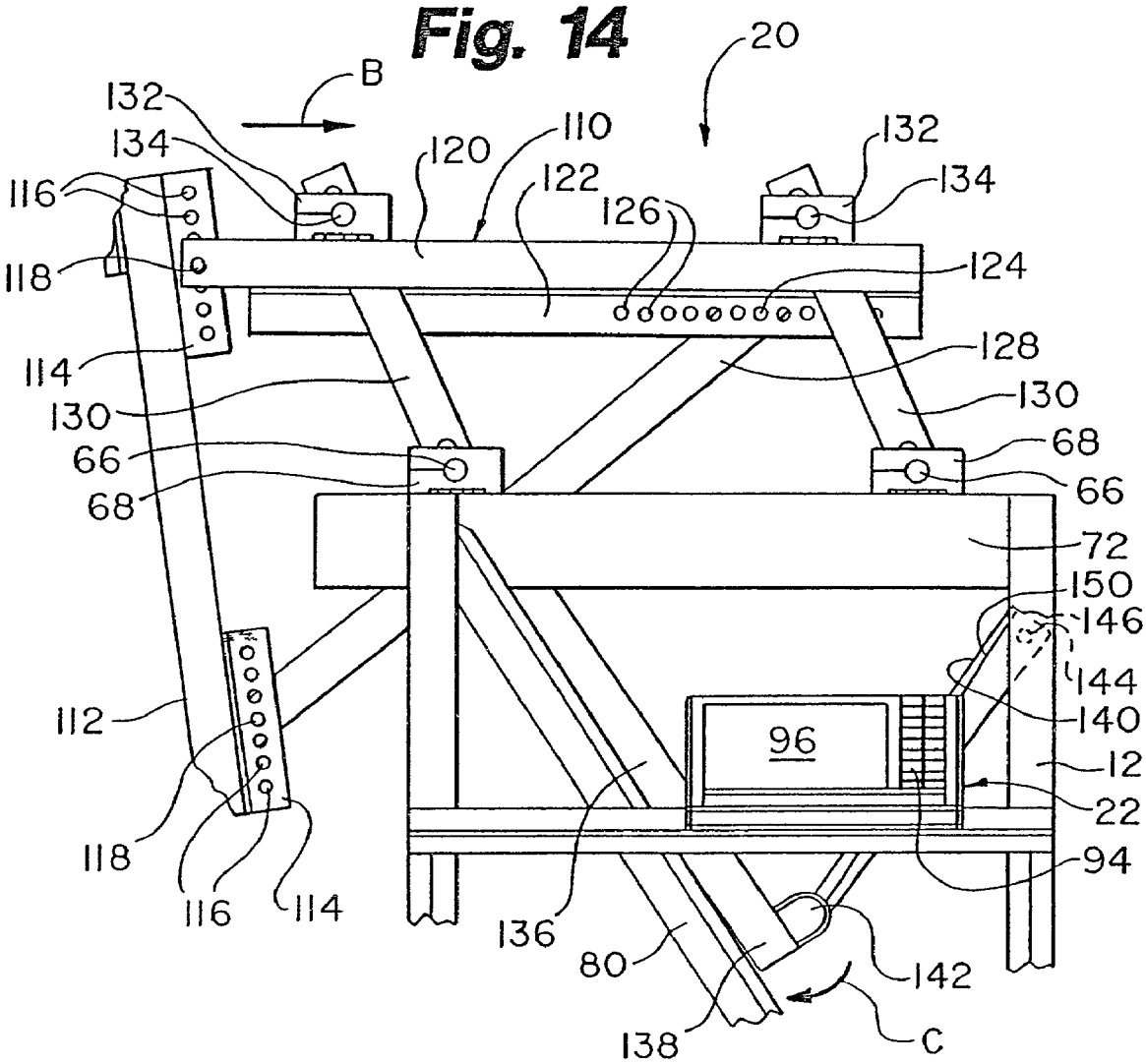
FIG. 14 is a side elevational view taken along the circle 14—14 of FIG. 13.
Figure 16:
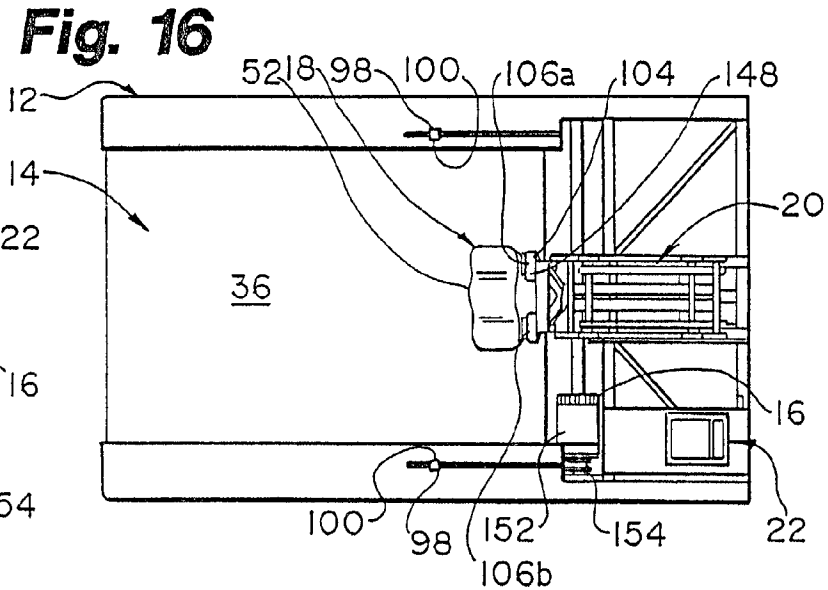
FIG. 16 is a top plan form view of the embodiment of FIG. 15.
Figure 17:
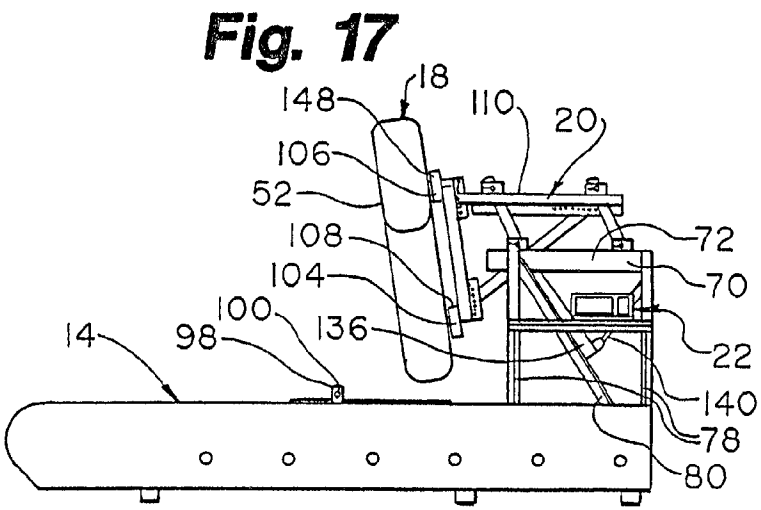
FIG. 17 is a side elevational view of the embodiment of FIG. 15.
Figure 15:
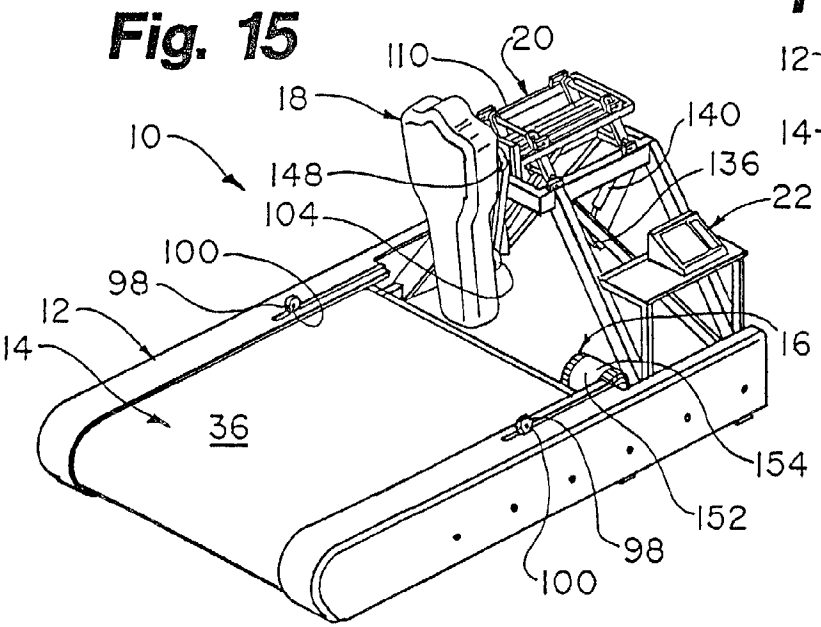
FIG. 15 is a perspective view of a fourth embodiment of the present invention.
Figure 18:
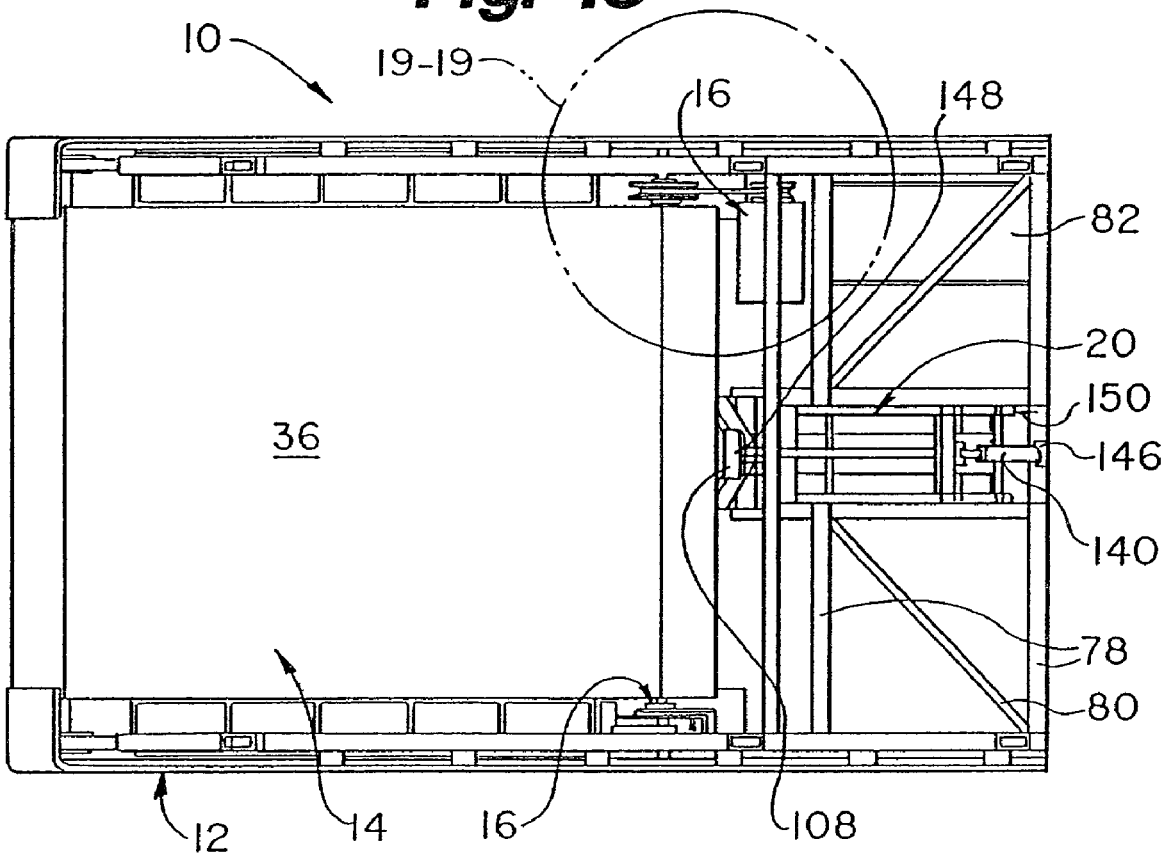
FIG. 18 is a bottom plan form view of the embodiment of FIG. 15.
Figure 19:
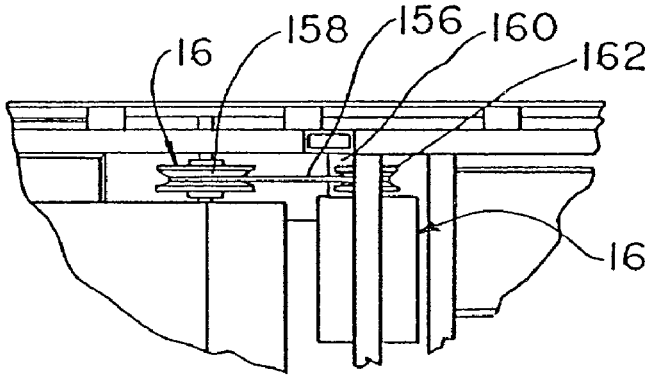
FIG. 19 is a bottom plan form view of the motor and drive assembly taken along circle 19—19 of FIG. 18.
Figure 20:
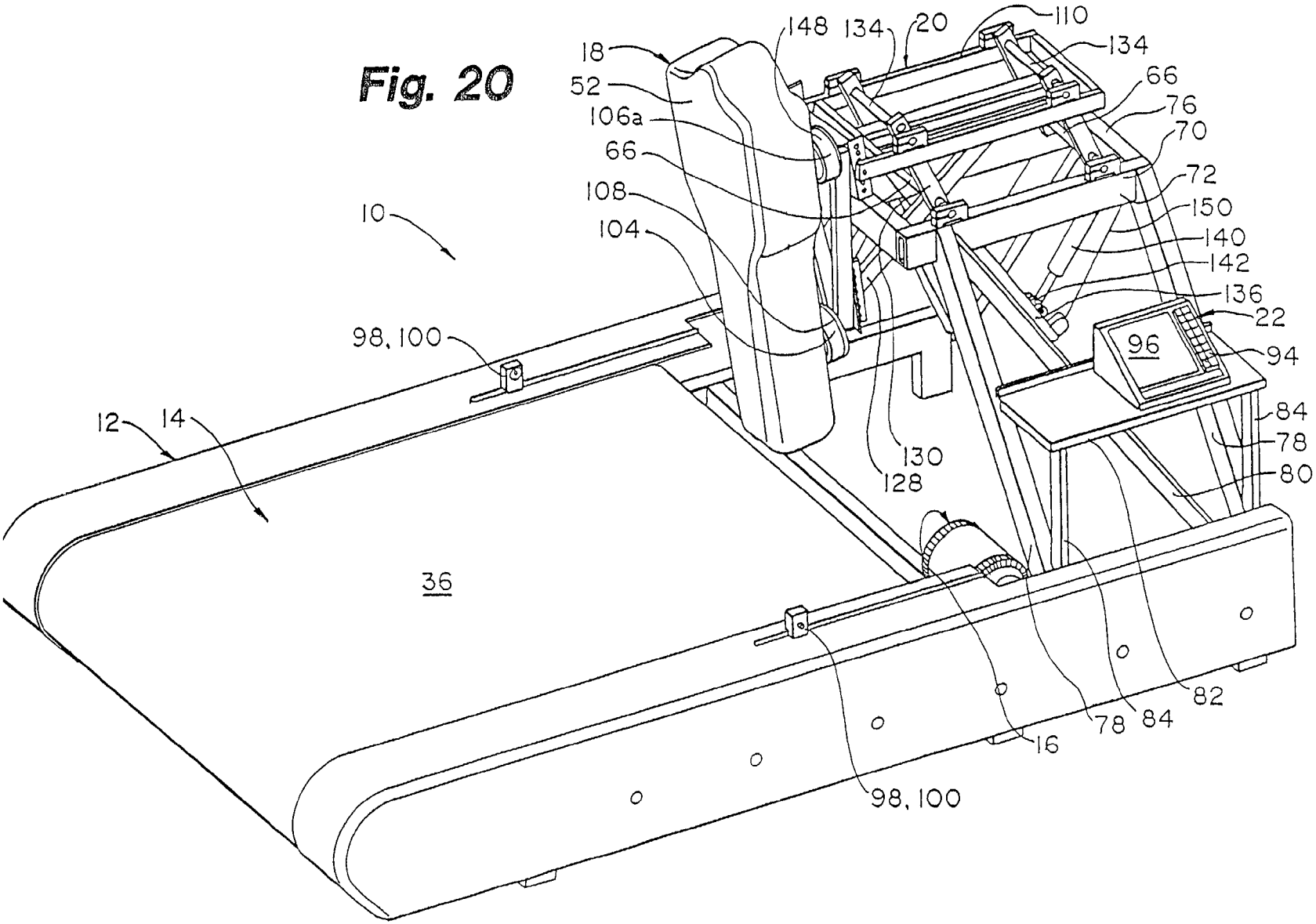
FIG. 20 is a perspective view of the embodiment of FIG. 15.
Figure 21:
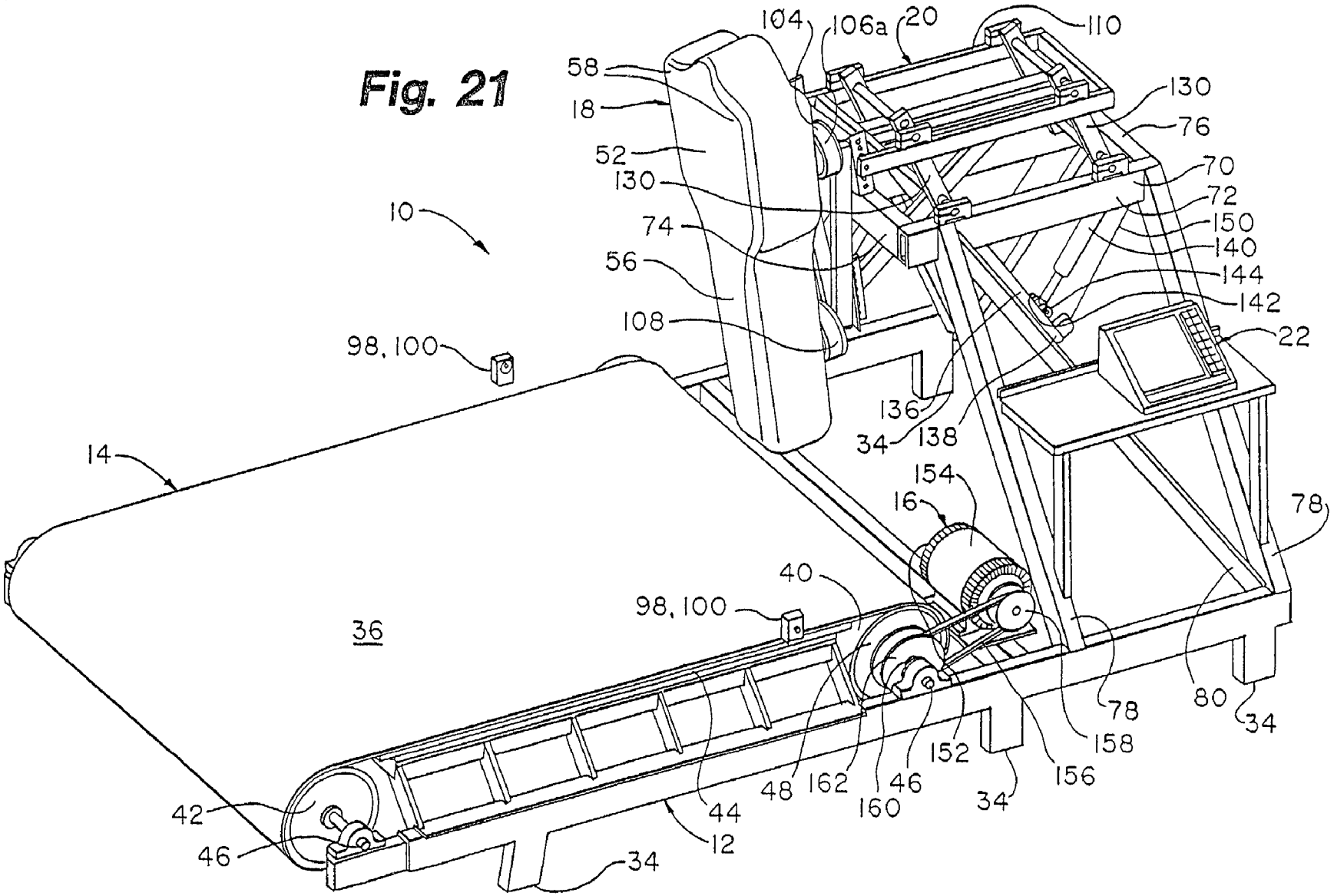
FIG. 21 is a side elevational view with components broken away to reveal the treadmill and drive components.

A second embodiment of the treadmill sled 10 of the present invention is depicted in FIG. 9. The treadmill sled 10 of FIG. 9 includes an enhanced controller 90 having a processor for calculating selected parameters based on sensed quantities. The braking system including the disk brake 48 and variable caliper 50 is used to estimate force production of a user athlete. A calibration procedure is generally conducted by the controller 90 to determine the force required to rotate the friction loaded disk brake 48. As a result of applying a regression equation, the pressure applied by the variable caliper 50 to the disk brake 48 is utilized to predict the force required to rotate the continuous belt 36 of the treadmill sled 10. After varying the pressure applied to the disk brake 48, a second experiment may be conducted to estimate the force required to turn the belt 36 of the treadmill sled 10. These values used in conjunction with the treadmill displacement as measured by the rotary encoder 102 and the time over which the displacement was effected results in an estimation of power output. Further embodiments of the measurement system 22 are described in detail herein.

A third embodiment of the treadmill sled 10 is depicted in FIGS. 10–14. A major difference between this embodiment of the treadmill sled 10 and the previous two embodiments of the treadmill sled 10 is found in the dummy support 20.

The dummy support 20 here includes a three point attachment 104 for supporting the blocking dummy 18. The three point attachment 104 includes two spaced apart shoulder attachments 106*a*, 106*b* and a lower torso attachment 108. The three point attachment 104 is fixedly coupled to a shiftable support frame 110.

The shiftable support frame 110 includes a subframe 112 for direct coupling to three point attachment 104. The subframe 112 has at least two flanges 114, the flanges 114 having a plurality of adjusting holes 116 defined therein. By selecting the desired adjusting hole 116 on the flanges 114, the relative height of the blocking dummy 118 can be adjusted as desired. The upper flange 114 is fixedly coupled to a horizontal support 120 by a pin 118 The horizontal support 120 has depending flange 122 fixedly coupled to the underside margin thereof. The depending flange 122 has a plurality of holes 126 defined therein. A pin 124 disposed in a selected hole 126 may be coupled to a rising support 128. By selecting a desired hole 126 for coupling with the rising support 128, the angle of the blocking dummy 18 can be adjusted relative to a vertical disposition.

The rising support 128 is coupled at a first end to the flange 122 as indicated above. The rising support 128 is coupled at a second end to the lower flange 114 by a pin 118.

The shiftable support frame 110 further includes a pair of parallel pivoting arms 130. The pivoting arms 130 are pivotally connected to a respective receiver 132 mounted on the upper margin of the horizontal support 120 by pins 134. The respective parallel pivoting arms 130 are pivotally coupled at a second end to a respective receiver 68 by cross pins 66.

With the aforementioned structure, the side rail 72, the horizontal support 120 and the parallel pivoting arms 130 function as a shiftable parallelogram. A force imparted to the blocking dummy 18 will cause this parallelogram to shift as indicated by the arrow B in FIG. 14.

A depending moment arm 136 is fixedly coupled to the shiftable support frame 110. The moment arm 136 is coupled at a distal end 138 to a spring 140 by a pivotal coupling 142. The spring 140 is further pivotally coupled at a second end by a pin 144 forming a pivotal coupling 146 with the frame 12.

Motion as indicated by the arrow B that is imparted to the shiftable support frame 110 results in a rotation of the moment arm 136 as indicated by the arrow C. Accordingly, the motion indicated by arrow B is resisted by the bias exerted by the spring 140 on the distal end 138 of the moment arm 136.

The motion of arrow B results in a measurable extension of the spring 140. Accordingly, an extension sensor 150 may be utilized in conjunction with the spring 140. Additionally, individual force sensors 148 may be associated with each of the attachments 106*a*, 106*b*, and 108 of the three point attachment 104.

With the third embodiment of the treadmill sled 10, the extension sensor 150 is utilized to estimate force production of a user athlete exerting a force on the blocking dummy 18. As a result of applying the regression equation, the linear displacement through extension or lengthening of the spring 140 by the force exerted by the user athlete is utilized to estimate the force required to effect such extension. This value plus the spring displacement, treadmill displacement, and time of exerting the force results in an estimate of power output by the user athlete.

Force exerted by the user athlete is directly measured as close as possible to where the user athlete impacts the blocking dummy 18, thereby resulting in no significant losses into the supporting structure. This is accomplished with the multi-axis force sensors 148 associated with the attachments 106*a*, 106*b*, and 108. These force sensors 148 or load cells are kinematically mounted so that their measurements can be added to obtain the resultant forces and moments. Unlike existing field sleds used in practice, the treadmill sled 10 of the present invention provides an inertial reference frame in which the magnitudes and directions of the forces exerted by the user athlete can be directly measured. Instantaneously measuring the forces at the at least one force sensor 148 provides the data necessary to calculate the position of the applied forces with respect to the blocking dummy 18, their magnitude, and their directions.

Further, displacement of the continuous belt 36 is generally measured by the rotary encoder 102. Displacement of the spring 140 is measured by the extension sensor 150. The signal received from the foregoing sensors are collected and processed by a data acquisition card and processor in the controller 90. An actuating switch 94 triggers the start of data acquisition. The photoelectric cell 100 indicates the user athlete's initial movement and an internal clock in the controller 90 keeps track of time expended throughout an evolution. By reading the forces, displacements, and time, the controller 90 calculates the resulting output and displays on the readout 96.

The fourth embodiment of the treadmill sled 10 is depicted in FIGS. 15–21. A major addition to this embodiment as compared to the previous three embodiments is the inclusion of a power system 152. The power system 152 in its simplest forms includes an electric motor 154 that is operably coupled to a belt drive 156. The belt drive 156 is rotatably engaged with a pulley 158 that a fixedly coupled to the roller axle 46 of the first roller 40. Operation of the electric motor 154 acts to impart a rotational motion to the first roller 40, the first roller 40 acting on the continuous belt 36 to cause rotation thereof.

In a more sophisticated mode, the pulley 158 and the pulley 162 mounted on the output shaft of the electric motor 154 comprise a variable speed transmission 160 by cooperatively varying the effective diameter of the two pulleys 158, 162, the variable speed transmission 160 can effect a substantially infinite variable velocity of the continuous belt 36 while maintaining the rotational output of the electric motor 154 at substantially a constant revolutions per minute.

With the addition of the power system 152, the number of additional modes of operation of the treadmill sled 10 are possible. The first of such modes is the isokinetic mode of operation. In this mode, the treadmill belt 36 is driven at a constant velocity by the power system 152. Force is measured while performing blocking, charging, and tackling. User athletes are evaluated for their ability to apply forces at various velocities of the continuous belt 36. Different positions manned by the user player require testing and training at different velocities depending on the movement patterns normally performed by a player manning that position.

The second mode is isotonic. In this mode, a constant resistance is applied to the continuous belt 36 by the tension adjuster 51 acting on the variable caliper 50. The velocity of the belt 36 is free to change depending on the amplitude and frequency of the force supplied by the user athletes force supplied to the belt 36. The athlete user is then evaluated for the ability to block, charge, and tackle at various treadmill belt 36 resistances.

The final mode of operating is matching speed to maintain force production. In this mode of operation, force applied to the pad remains constant throughout the block, charge, or tackle. The controller 90 acts to increase or decrease the speed of the belt 36 by its control over the variable speed transmission 160 depending upon the amount of force applied to the pad. To increase force production, controller 90 lowers the velocity of the belt 36 and to reduce the force production, the processor 90 increases the velocity of the belt 36.

A further somewhat unrelated mode of operation is that utilized for pass blocking. In pass blocking, the offensive player is required to execute a series of back-pedaling movements interspersed with explosive contacts with the charging defensive player, while trying to remain positioned between the defensive player and the ball carrier. To simulate this skill on the treadmill sled 10, the isokinetic mode, described above, is utilized with the belt 36 turning in the opposition direction than would be used for the modes described above. The belt 36 travels at a constant velocity. The athlete user performs this back-pedaling motion to match the speed of the treadmill belt 36. An auditoric or visual stimulus to the user athletes signals when to make an explosive contact with the blocking dummy 18 (the pad), after which the user athlete returns to the back-pedaling movement. This is repeated for a number of times during a period of time lasting approximately 10 seconds. The force amplitude is measured for each contact with the blocking dummy 18.

Figure 22A:
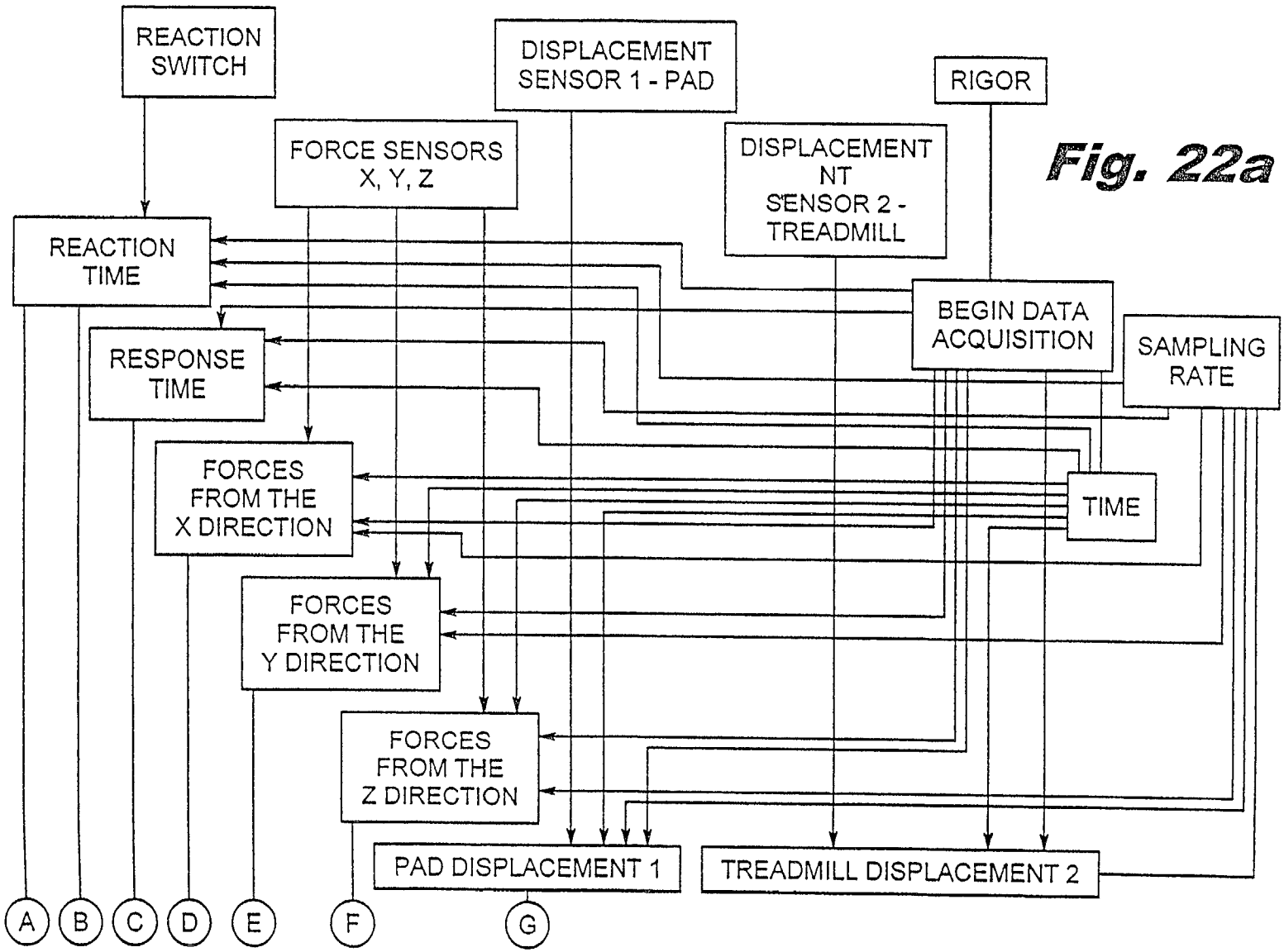
FIGS. 22*a*–22*c* are schematic diagrams of the program implemented on the embodiment of FIGS. 15 and 23.
Figure 22B:
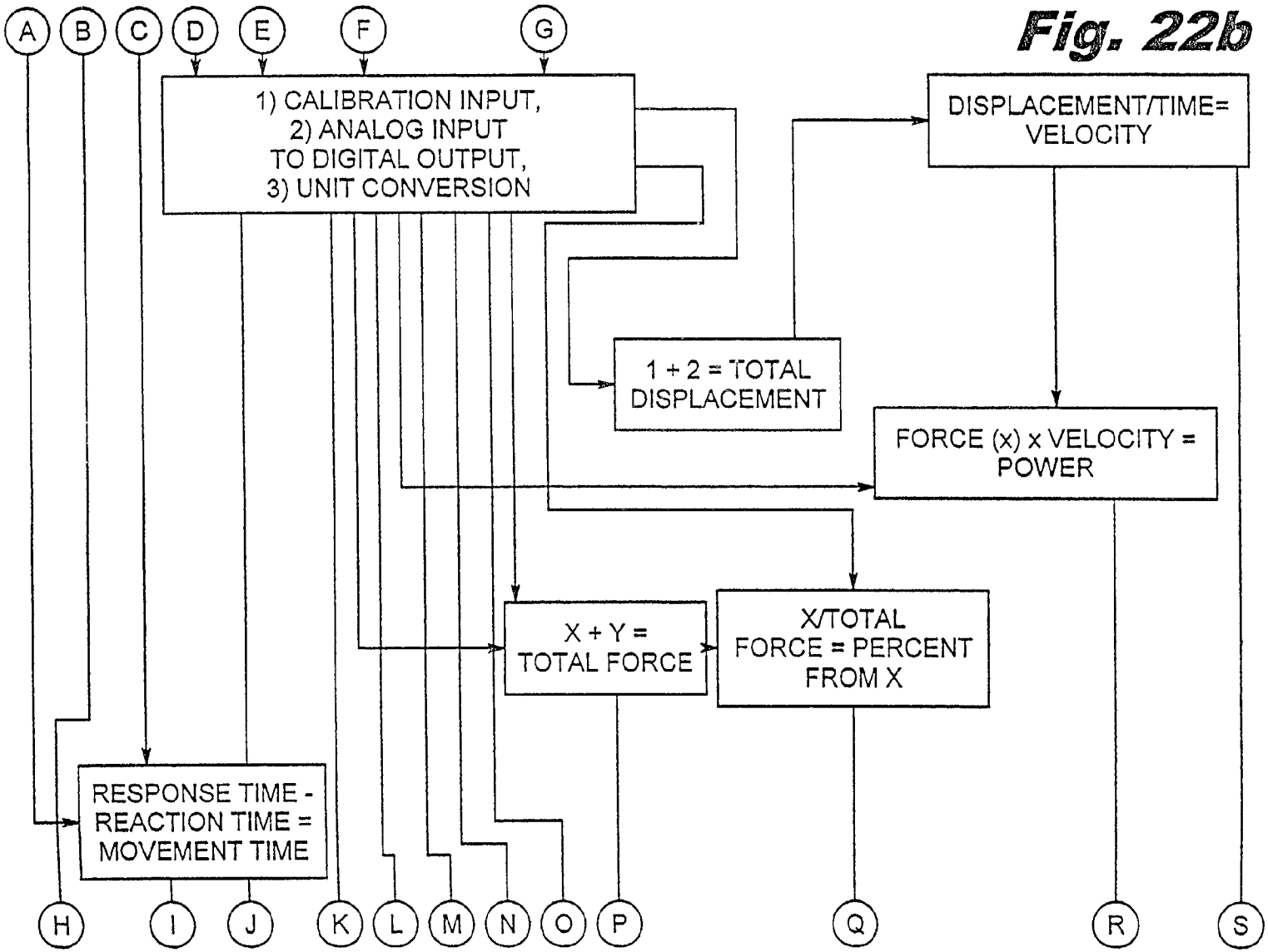
Figure 22C:
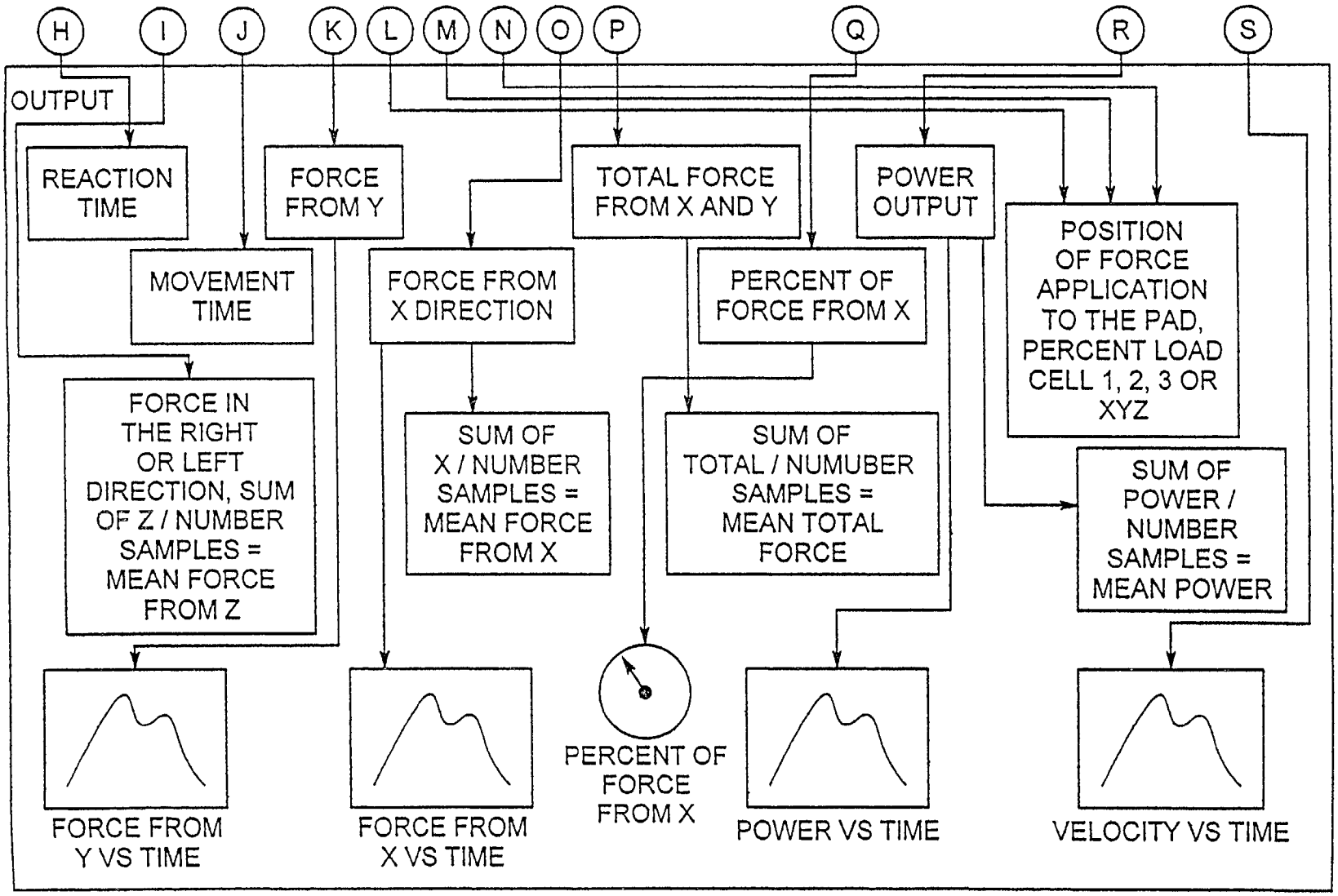
Figures 23, 24A:
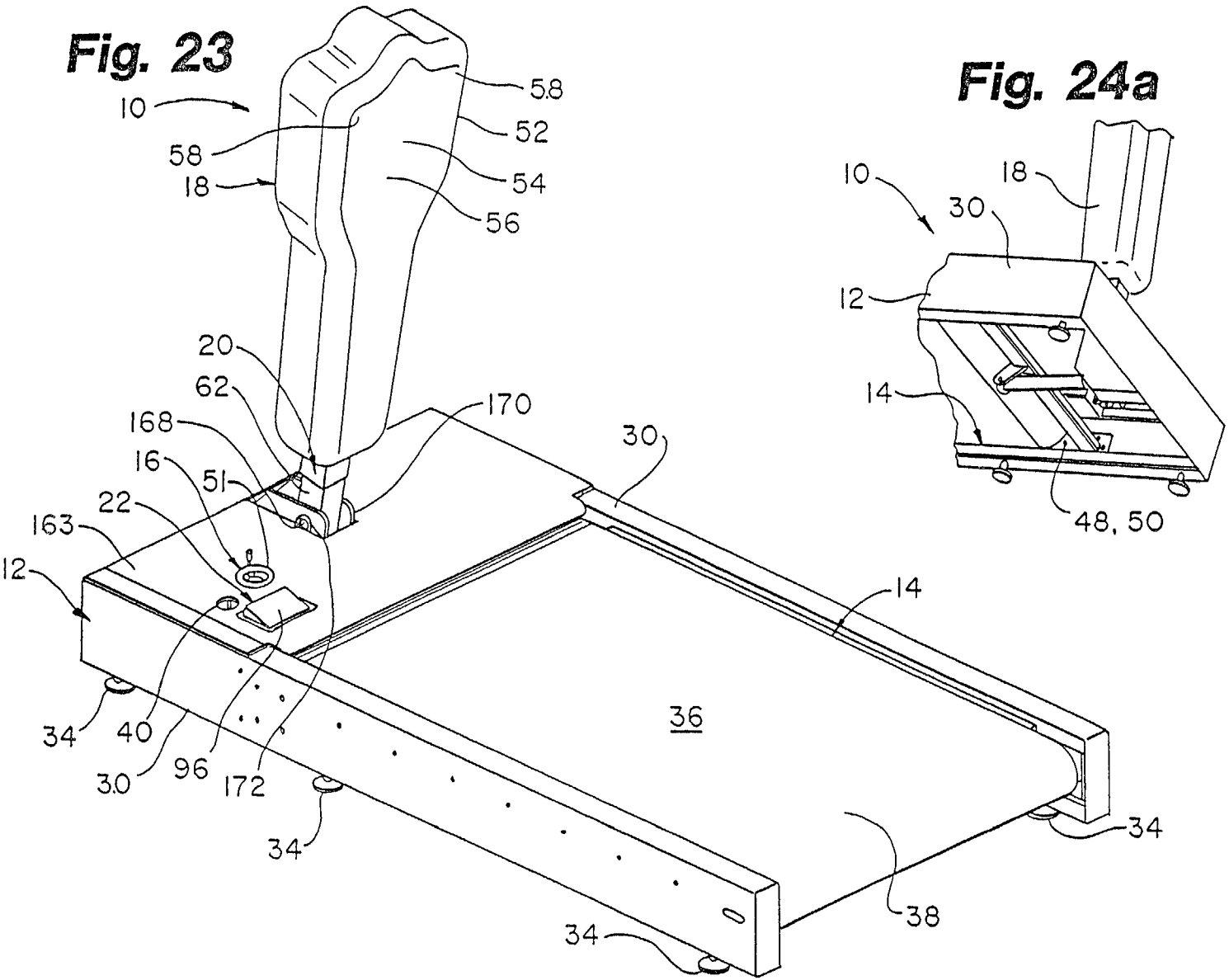
FIG. 23 is a perspective view of a further embodiment of the present invention.
FIG. 24*a* is a fragmentary bottom perspective view of a portion of the embodiment of FIG. 23.
Figure 24:
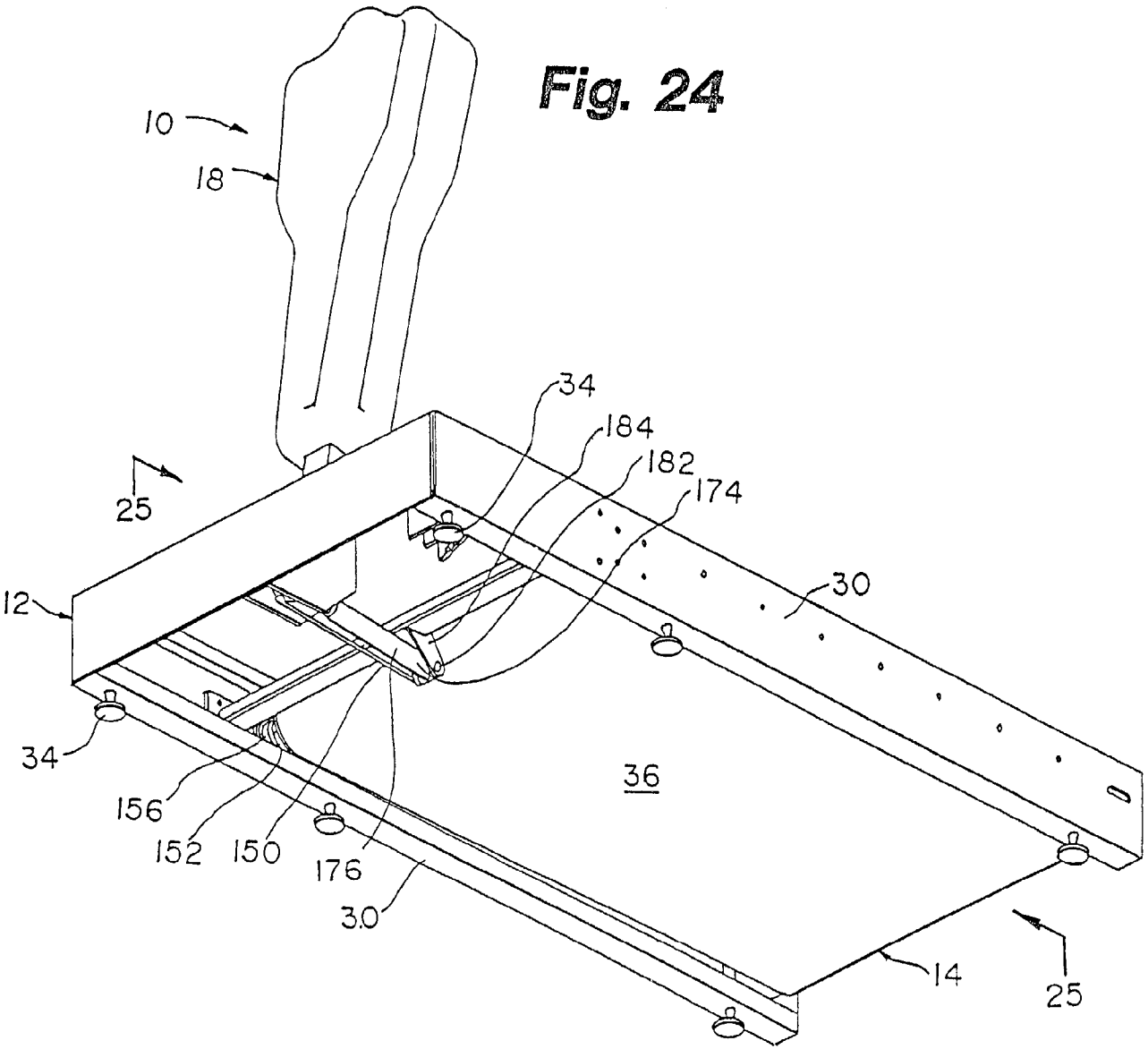
FIG. 24 is a bottom perspective view of the embodiment of FIG. 23.

FIG. 22 applies principally to the fourth embodiment described above. The controller, which includes a processor, performs the calculations detailed in FIG. 22 to arrive at a number of useful outputs that relate to the ability of the user athlete. The outputs are depicted in the output box at the lower portion of the figure. The graphic representations may be presented to the operator of the treadmill sled 10 on the readout 96 and may further get recorded for tracking of a particular user athlete's performance over a number of different sessions on the treadmill sled 10.

A fifth embodiment of the present invention is depicted in FIGS. 23–26. The design of FIGS. 23–26 was made in order to retain all the functions of the aforementioned designs yet reduce the mass and size of the treadmill sled 10. In order to accomplish this, the treadmill sled 10 substantially reconfigured. A platform 163 extends between the side supports 30 forward of the leading edge of the continuous belt 36. Controls and readouts for the performance measurement system 22 are positioned on the platform 163. The readout 96 is slightly elevated from the platform 163 and inclined toward the athlete user of the treadmill sled 10. It is further disposed toward a side of the treadmill sled 10 so that a coach or other monitoring individual can readily view the information presented on the readout 96.

Figure 25:
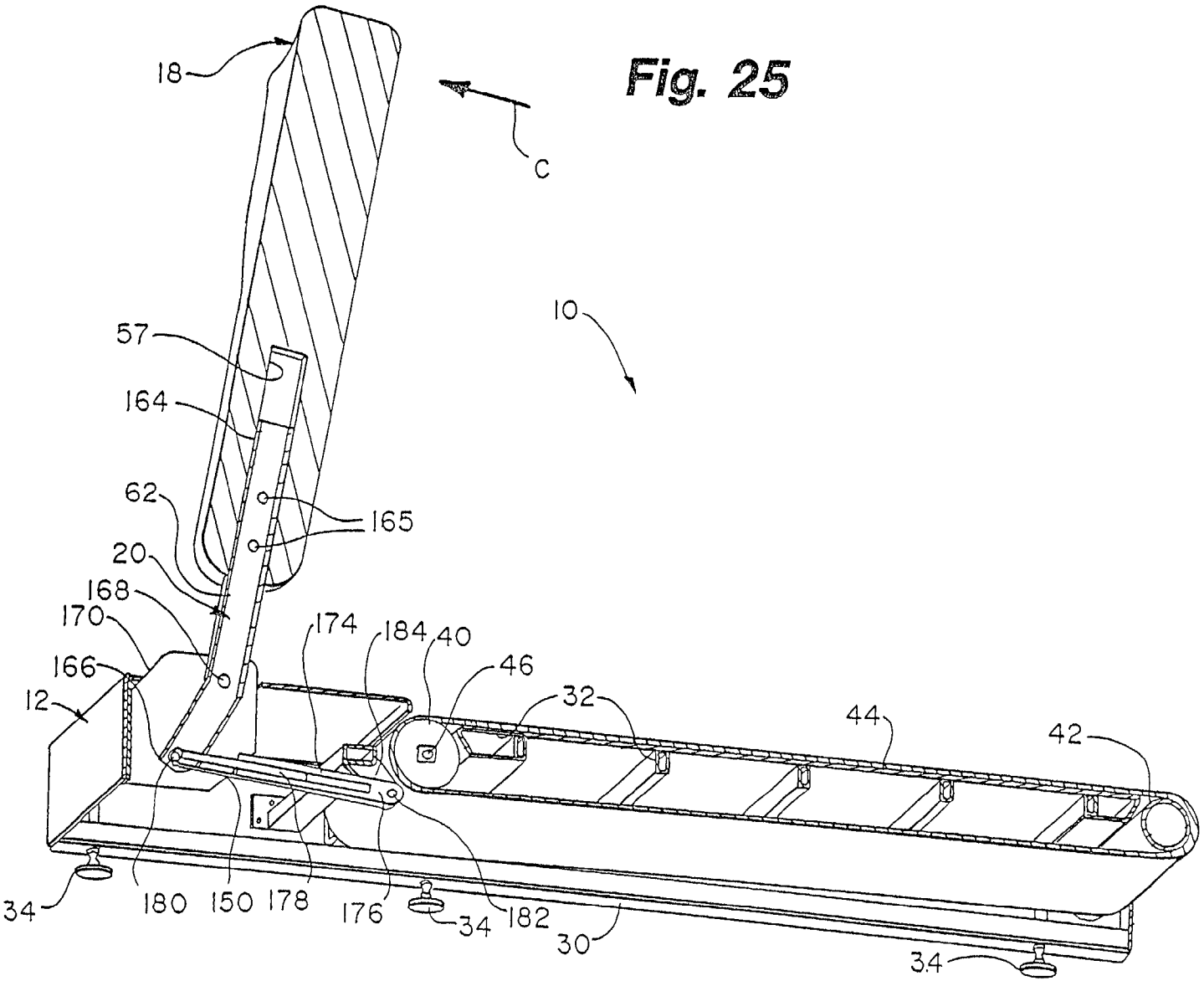
FIG. 25 is a perspective sectional view taken along the section line 25—25 of FIG. 24.
Figure 26:
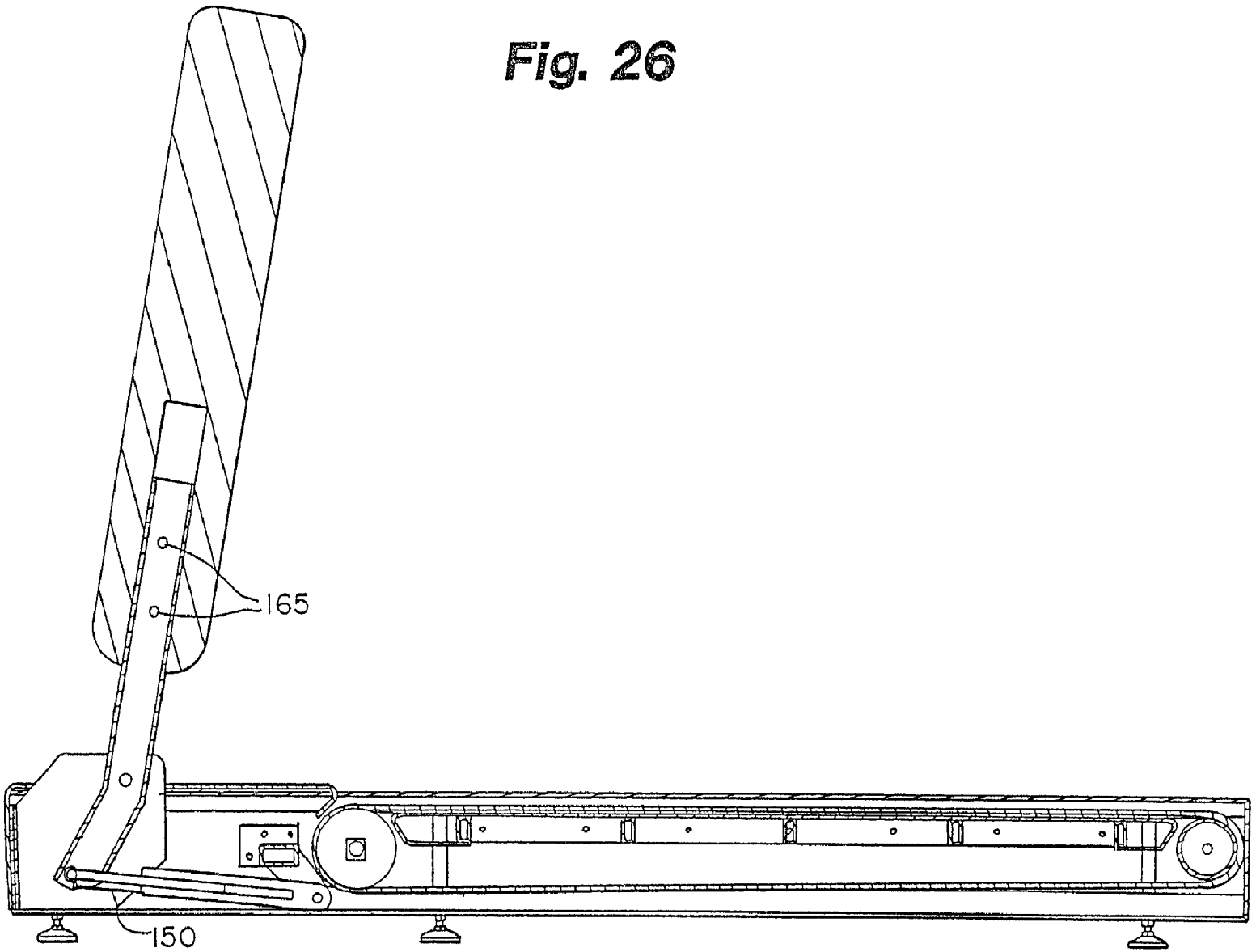
FIG. 26 is a sectional view taken along the section line 25—25 of FIG. 24.

Controlling elements of the treadmill control system 16 are positioned proximate the readout 96. The first such control is a pressure adjustment wheel 16. The pressure adjustment wheel 16 imposed a load on the variable caliber 50, which in turn applies pressure to the disk brake 48. See FIG. 24*a*. A pressure gauge 49 provides a pressure acting on the variable caliber 50. The pressure registered on the pressure gauge 49 that is dialed in by the tension adjuster 51 is sensed by the performance measurement system 22. The dummy support 20 of the present embodiment has been considerably changed with respect to the aforementioned dummy support 20. In the instant embodiment, beam 62 comprises a pivotable generally upright member. The beam 62 projects through an aperture defined in the platform 163. Referring to FIGS. 25 and 26, the beam 62 has a first end 164 that is removably received within a receiver 57 defined in the blocking dummy 18. The first end 164 is secured to the blocking dummy 18 by fasteners 165 that may be removable for replacement of the blocking dummy 18 or for the height of the blocking dummy 18 relative to the platform 163. The fasteners 165 may be pins or bolts or the like that are readily accessible for ease of removal as desired.

The beam 62 is pivotally coupled to the frame 12 at a pivot point 168. The beam 62 may be coupled by a pivot pin 172 disposed in bores that are in registry and defined in the beam 62 and in two flanking support brackets 170 disposed on either side of the beam 62. The support brackets 170 are fixedly coupled to the frame 12.

A second end 166 of the beam 62 depends from the pivot point 168. In one embodiment, a slight bend in the beam 62 proximate the pivot point 168 projects the send end 166 toward the forward end of the treadmill sled 10.

A damper 74 operably couples the second end 166 of the beam 62 to the frame 12. In the sectioned representation of FIGS. 25 and 26, it can be seen that the damper 174 has a cylinder housing 176 and a translatable piston 178 disposed in part within the cylinder housing 176. The piston 178 is coupled by a pivotable coupling 180 to the second end 166 of the beam 62. Likewise, the cylinder housing 176 is coupled by a pivotable coupling 182 at a distal end thereof to a damper bracket 184. The damper bracket 184 can have two portions that flank the cylinder housing 176. The damper bracket 148 is fixedly coupled to the frame 12.

A force as indicated by arrow C in FIG. 25 that is imparted to the blocking dummy 18 results in the beam 62 rotating about the pivot point 168. Such action forces the piston 178 into the cylinder housing 176 against a resistance that can be hydraulic. The amount that the piston 178 is forced into the cylinder housing 176 is measured by an extension sensor 158. The extension sensor 158 can be a string potentiometer that is disposed generally parallel to the damper 174. The output of the extension sensor 150 can be connected to the performance measurement system 22.

Figure 27:
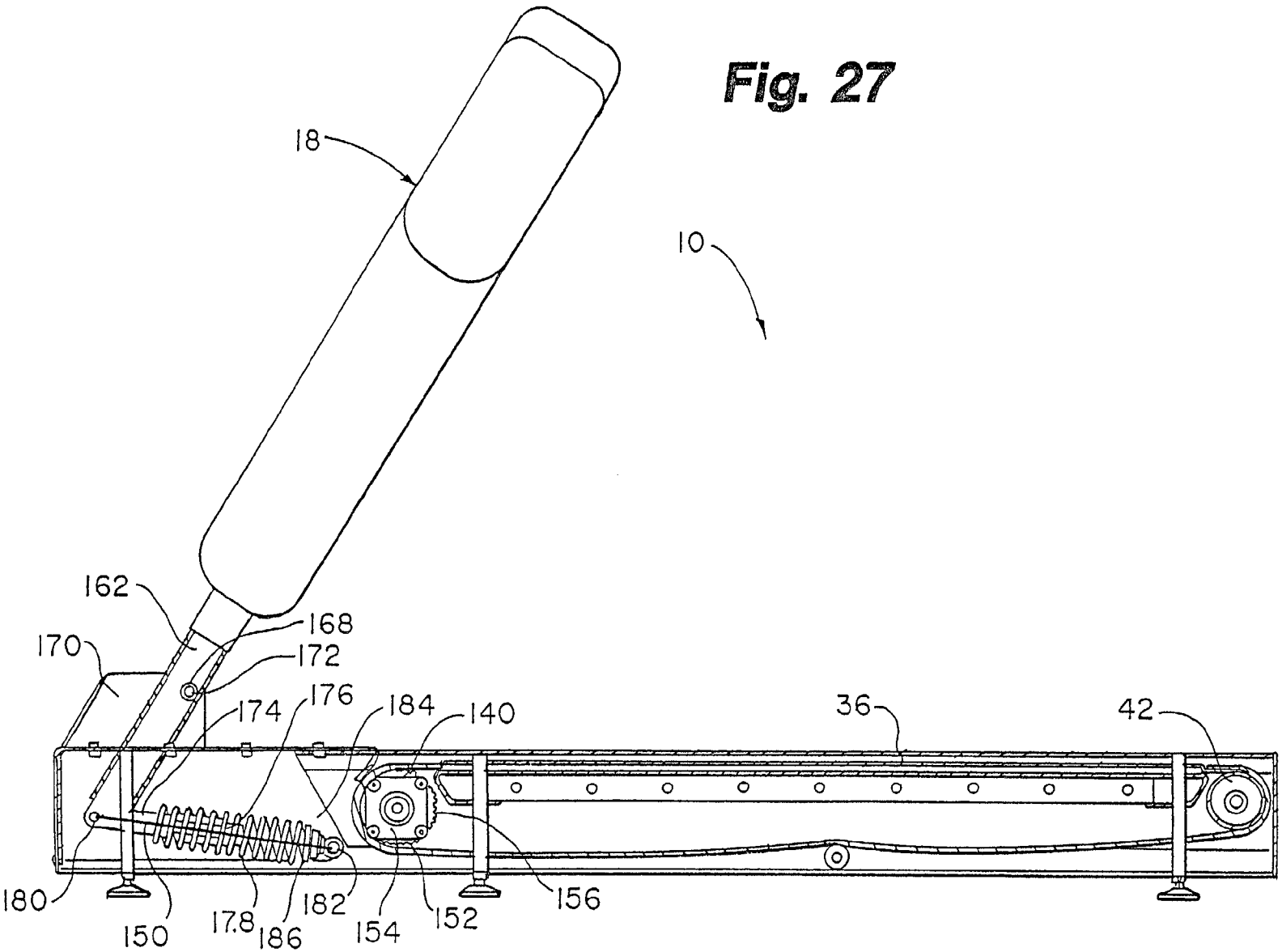
FIG. 27 is a sectional side view of another embodiment of the present invention.
Figure 28A:
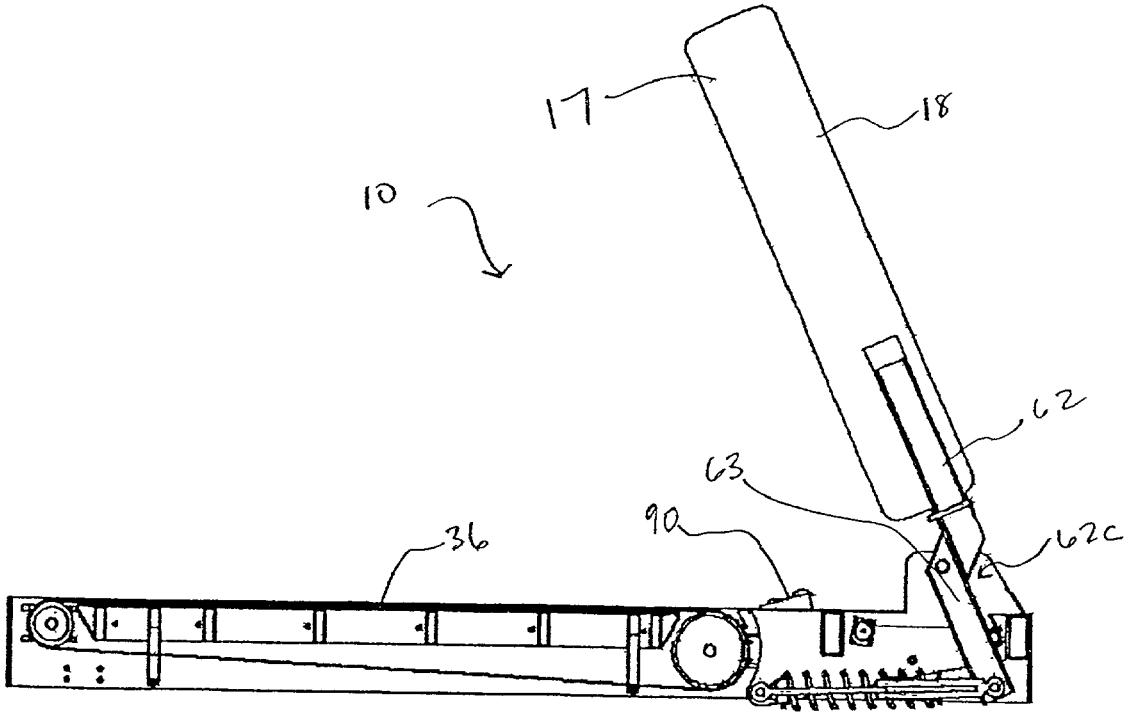
FIG. 28*a* is a sectional side view of another embodiment of the present invention.
Figure 28:
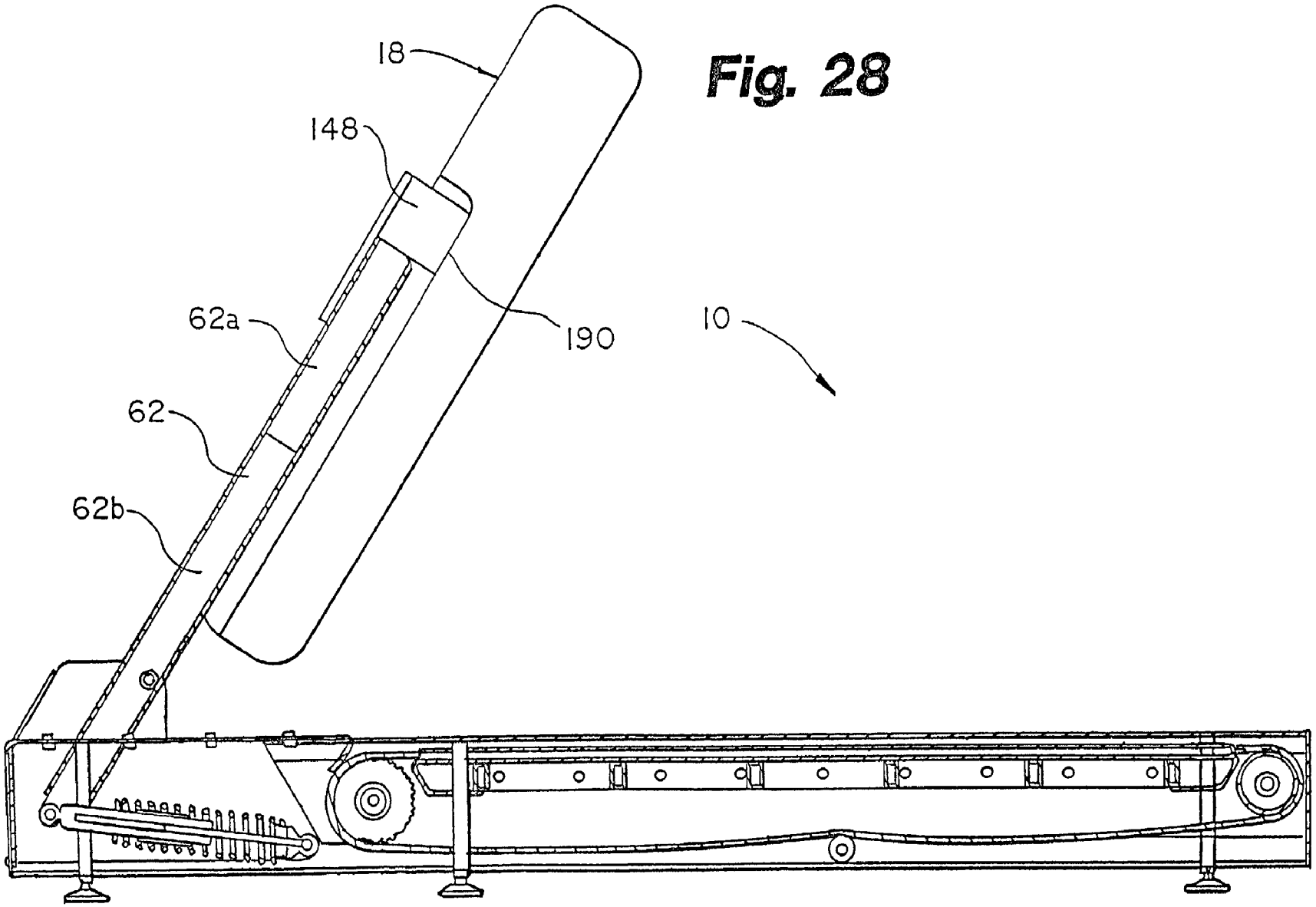
FIG. 28 is a sectional side view of the embodiment of FIG. 27 wherein the blocking dummy is mounted on a load cell.
Figure 29:
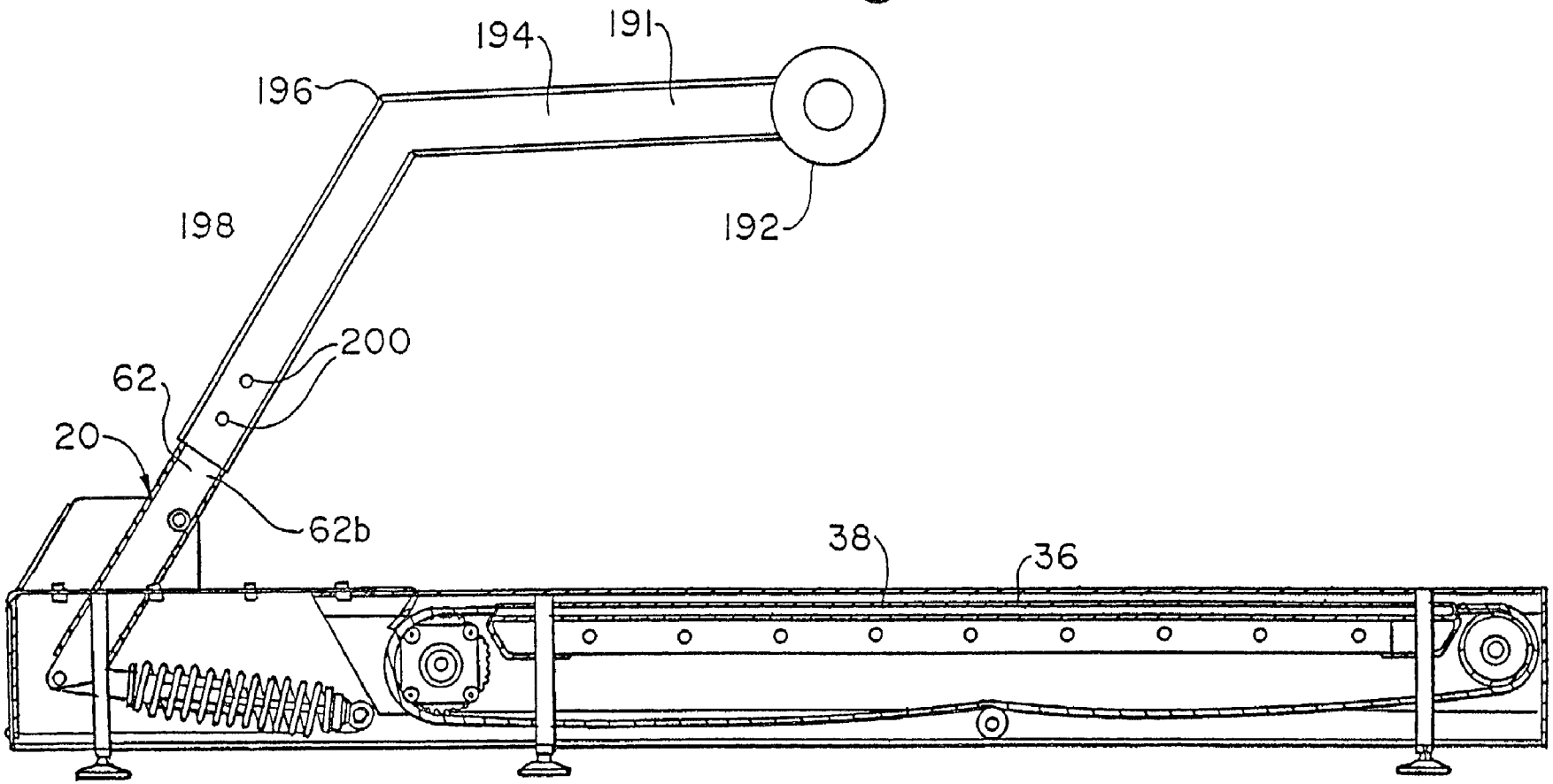
FIG. 29 is a sectional side view of the embodiment of FIG. 27 having a pad for resistive running.

A sixth embodiment of the treadmill sled 10 of the present invention is depicted in the sectional representations of FIGS. 27–29. These embodiments of the treadmill sled 10 may or may not include performance measuring system 22 as described with reference to the previous embodiments. As depicted in FIG. 27, the treadmill sled 10 includes a power system 152 having an electric motor 154 and a belt drive 156. Further, this embodiment traditionally includes a variable speed transmission coupling the electric motor 154 to the first roller 40.

Figure 27A:
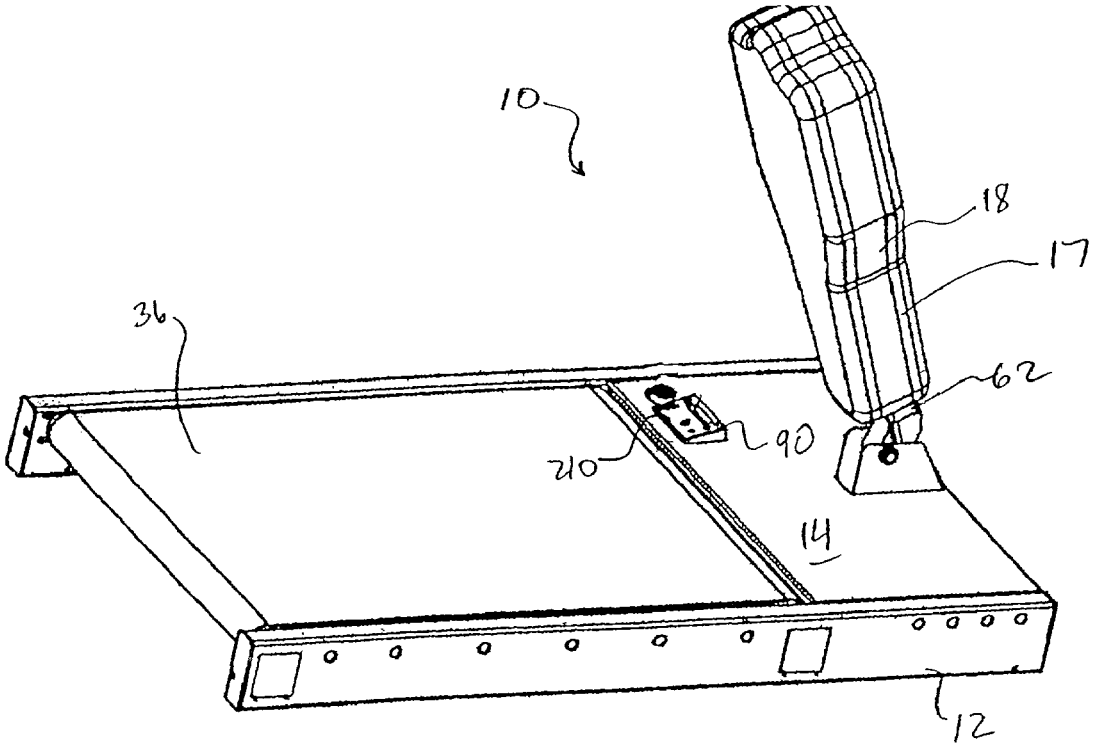
FIG. 27*a* is a perspective view of another embodiment of the present invention.

In the embodiment of FIGS. 27 and 27*a*, the treadmill sled 10 is a generally straight beam 62. The configuration results in the blocking dummy 18 being tilted downward toward the continuous belt 36. An athlete impacting the blocking dummy 18 must exert both an upward and forward force on the blocking dummy 18. In the embodiment of FIG. 27, the blocking dummy 18 is coupled to the beam 62 substantially as described with reference to the embodiment of FIGS. 25 and 26.

In the embodiment of FIGS. 27–29, a coil over spring 186 is generally disposed about the damper 174. The coil over spring 186 acts in cooperation with the damper 174 to resist the force imparted to the blocking dummy 18 by an athlete disposed on the continuous belt 36.

Turning to FIG. 28, the blocking dummy 18 is coupled to the beam 62 by a single point attachment 190. The single point attachment 190 includes a force sensor 148 disposed therein. The force sensor 148 is in communication with the performance measurement system 22 and can include a single axis or multi-axis load cell for sensing force in operable communication with the controller 90 and the performance system 22, wherein the load cell sensor 148 can be mounted on any of the embodiments of the present invention. It should be noted that the beam 62 is formed of two collinear portions, beams 62*a* and 62*b*. The beam 62*a* is detachable from beam 62*b*, leaving a stub of the beam 62. Alternatively, as shown in FIG. 28*a*, an offset pivot beam assembly 62*c* can be utilized. The assembly 62*c* generally includes the beam 62 and an offset beam 63 such that the dummy 18 can be offset to allow for more available space for the user on the invention 10.

With reference to the embodiment of FIG. 29, a resistive running device 191 is coupled to the beam 62*b*. The resistive running device 191 includes a generally tubular pad 192. The tubular pad 192 is disposed generally at a height that approximates the lower torso portion of a runner. Accordingly, a runner disposed on the continuous belt 36 is positioned with the lower torso, upper pelvic region resting against the pad 192.

The tubular pad 192 is fixedly coupled to an arm 194 that extends forward from the pad 192. The arm 194 preferably has an elbow 196 and a generally depending connecting 198. The connecting arm 198 is connected to the beam portion 62*b* by readily removable pins 200. A plurality of bores may be defined in either or both the connecting arm 198 and the beam portion 62*b* in order to adjust the height of the pad 192 relative to the support surface 38 of the continuous belt 36.

In operation, the embodiment of FIG. 29 may be utilized with a certain amount of rotational resistance dialed in to the continuous belt 36 by the tension adjuster 51 acting on the variable caliber 50. A user may then lean into the tubular bed 192 and exert a certain amount of running force on the support 38 of the continuous belt 36.

Figure 31:
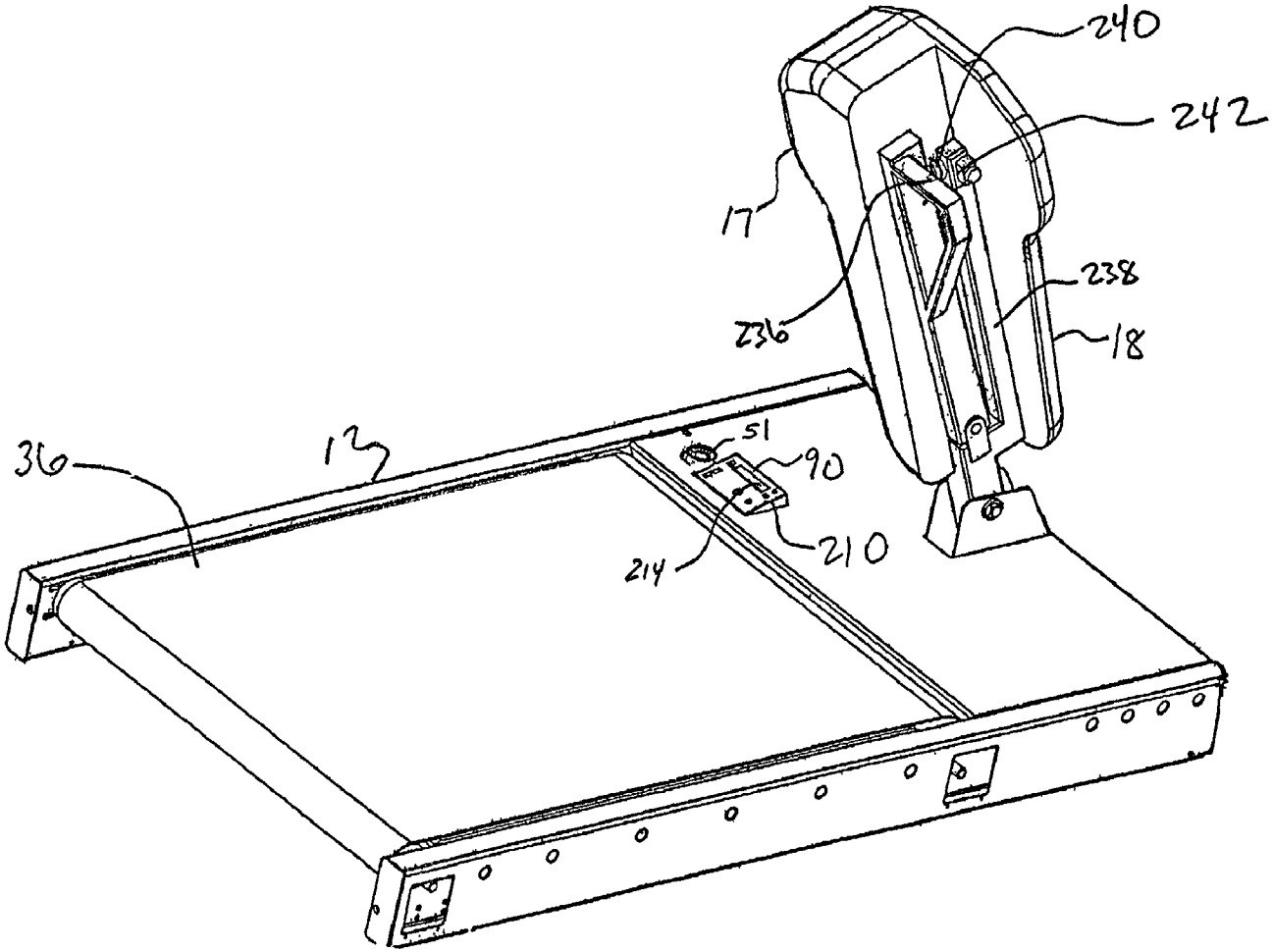
FIG. 31 is a perspective view of an embodiment of the present invention.

In an embodiment shown in FIG. 31, the blocking dummy 18 further includes a hinged pad beam 236, a support beam 238, at least one spring 240, and at least one spring potentiometer 242. The hinged pad beam 236 and support beam 238 can be removably fixed to the dummy 18 along the same upward plane as the dummy 18. The pad beam 236 and support beam 238 are generally parallel and spaced from each other with the at least one spring 240 providing an intermediate tensioned contact, wherein the movement of the beams 236, 238 toward one another causes a corresponding compression tension on the spring 240. Connected to, or abutting, at an end of the spring 240 is the potentiometer 242 which senses the compression force being applied on the spring. In turn, the potentiometer 242 is in operable communication with the controller 90 and its performance measurement system 22. As such, compression readings from the at least one potentiometer 242 are communicated to the controller 90 for use by the automated control and assessment system program 210 detailed herein.

In one embodiment, there are spring 240 and corresponding potentiometer 242 sets spaced proximate each end of the dummy 18 such that one set is proximate the support 20 and the other is attached distal the support 20. With such a configuration, it is possible to accurately measure the force magnitude according to the contact location and compression from the athlete user against the dummy 18. As the user motions along the belt 36 the user assumes a generally crouched position to forcibly contact the dummy 18 at a target location. The controller 90 and control and assessment program 210 can calculate the height and magnitude of the force from the communicated converted signal to the controller 90. In alternative embodiments, the spring 240 and potentiometer 242 sets can be selectively located along the parallel beams 236, 238 in accordance with specific compression, location, and magnitude measurements to be calculated and processed.

Tethered Sprinting

Figure 32:
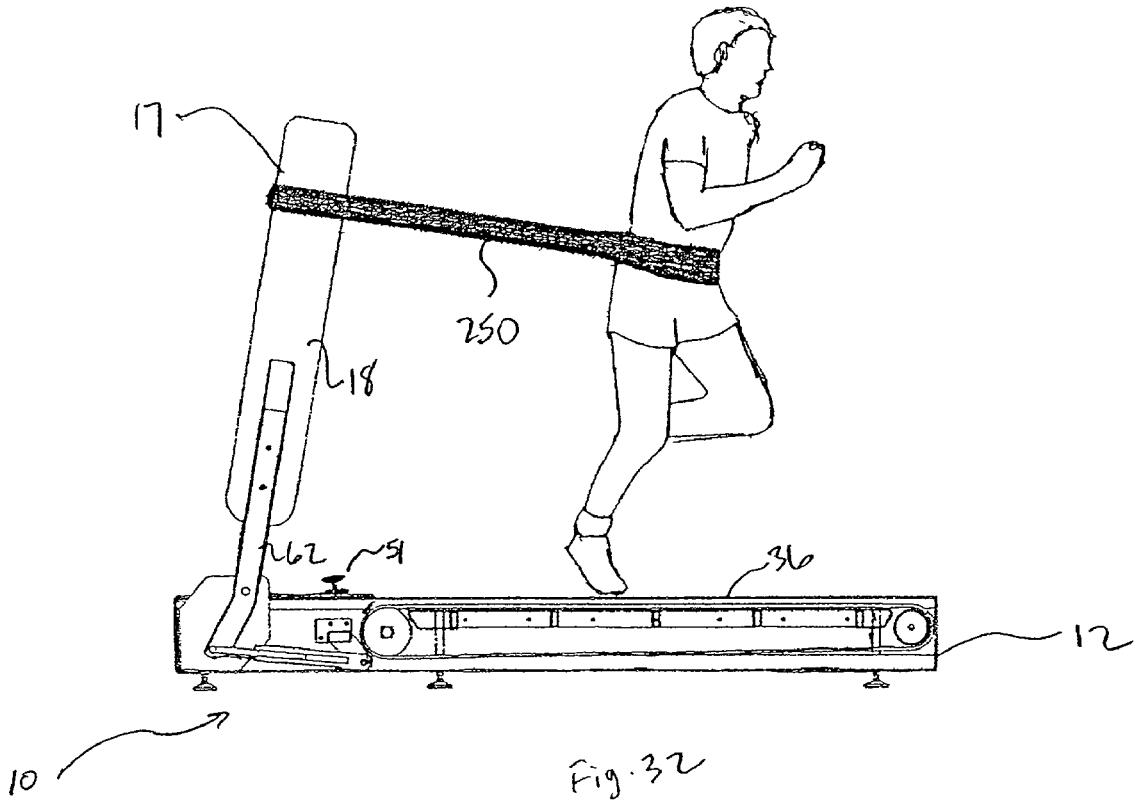
FIG. 32 is a perspective view of an embodiment of the present invention for sprint training.
Figure 34:
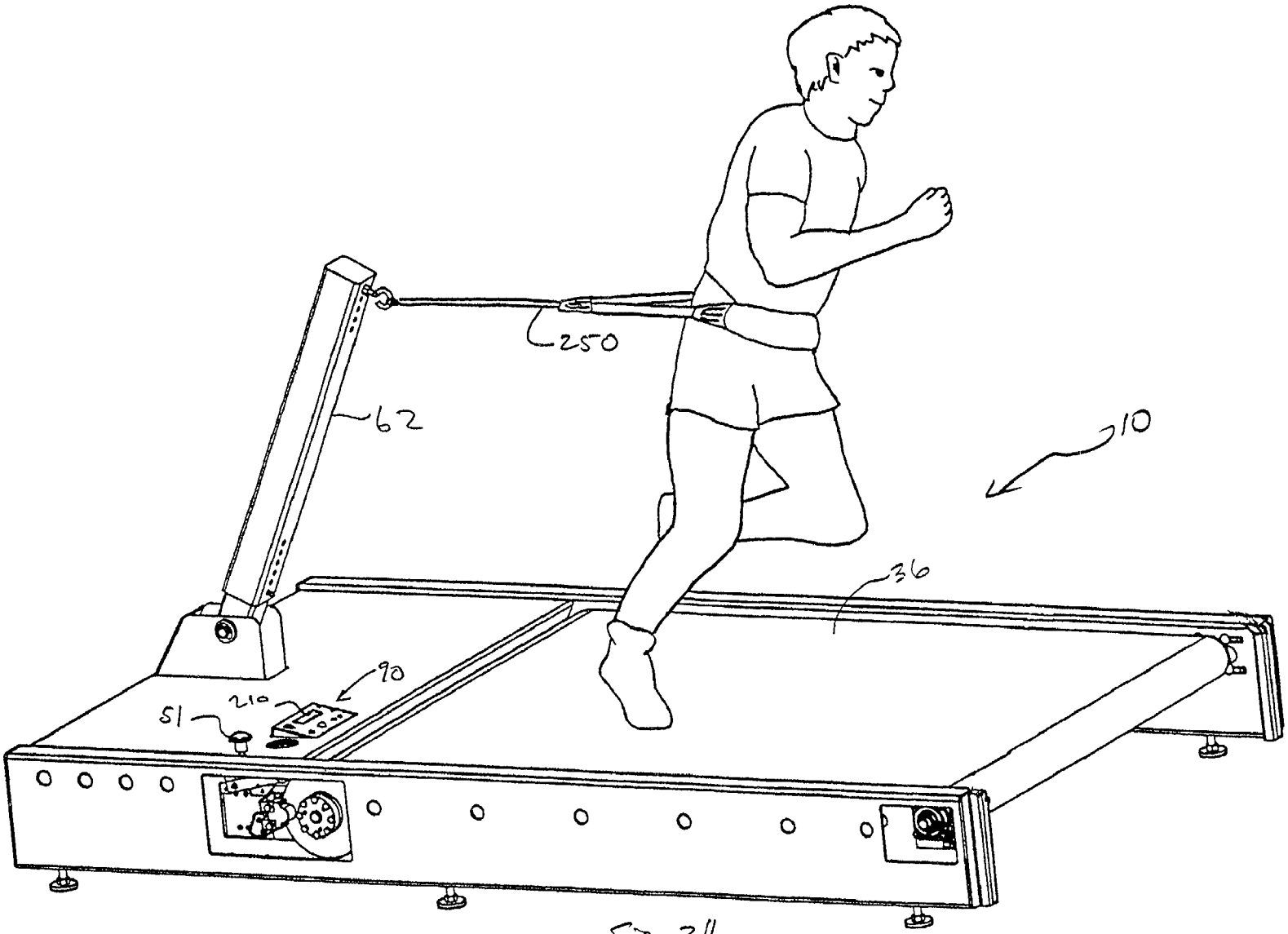
FIG. 34 is a perspective view of an embodiment of the present invention for sprint training.

Embodiments of the present invention 10 can be configured for facilitating, controlling, and assessing sprinting motions and activities. In one embodiment, as shown in FIG. 32, a generally looped tether strap 250 is removably selectively secured around the dummy 18 at one end. In such an embodiment, the dummy 18 of any of the invention embodiments described herein can include fasteners or securing means for securely receiving an end of the strap 250. For instance, hooks and latches connectors (i.e., Velcro), hooks, snapping devices, buckled fastening, and a myriad of other connecting techniques can be implemented without deviating from the spirit and scope of the present invention. In addition, it is envisioned that the pad 34 can be removed such that the strap 250 is attached or looped to the beam 62, as shown in FIG. 34.

As with various embodiments of the present invention 10, the belt 36 is generally without motor power. Instead, a resistive sprinting session is driven by the sprint power of the user athlete on the belt 36. A brake system 48 as described herein can be utilized in conjunction with this treadmill sled sprinting embodiment. Further, the tension adjusters 51 and variable calibers 50 can increase the coefficient of friction to adjust friction. Friction resistance can be adjusted according to training and user specific needs and goals. The end of the tether 250 opposite the fastened end is capable of receiving the user athlete, generally around the waist. In accordance with the height of the user, the attachment height of the tether 250 to the dummy 18 is correspondingly adjustable. As a result, the user is capable of performing simulated sprinting distances within the confines of the invention 10 since the tether 250 restricts the user while allowing for varying sprint levels. As described herein, distance, speed, and other readings from the belt and sprinting regime are fed to the controller 90 and control and assessment system 210 for processing.

Figure 33:
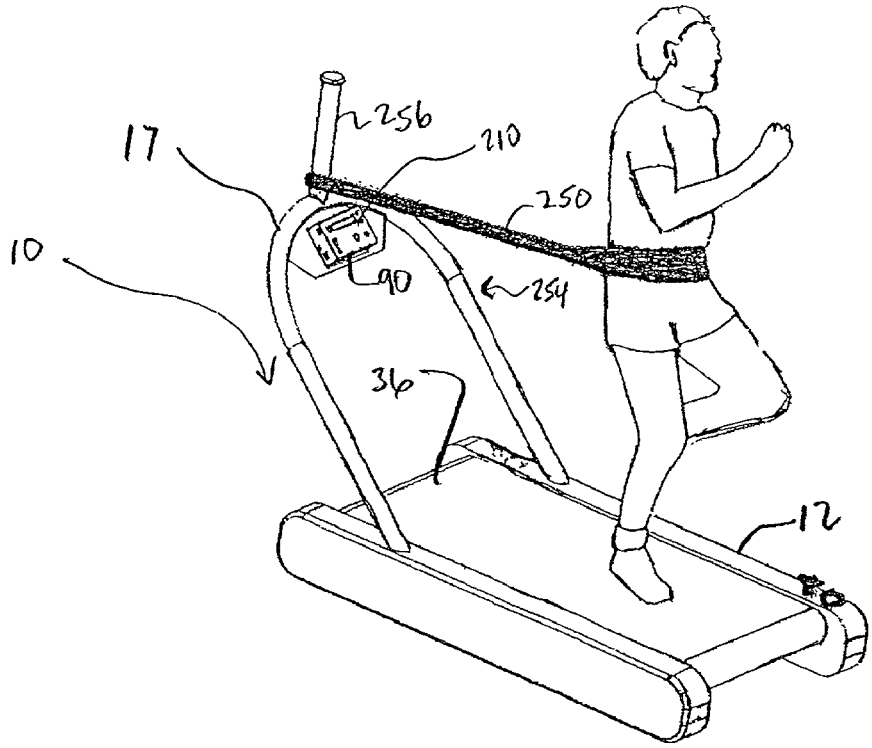
FIG. 33 is a perspective view of an embodiment of the present invention for sprint training.

Another tethered sprinting embodiment of the present invention can include a powermill system 252, as shown in FIG. 33. Rather than removably attaching the tether strap 250 to the dummy 18, a tether support frame system 254 is included. The frame system 254 comprises at least one vertical support bar 256. The support bar 256 is capable of receiving an end of the tether 250 distal the loop end that receives the user. The strap 250 can be fastened as described herein, or simply looped over the bar 256. As with other sprinting embodiments, simulated sprinting distances and speeds can be simulated and processed within the confines of the system 252.

In any of the embodiments, tackling/blocking and sprinting in particular, of the present invention, at least one force sensor 148 or 260 can be included to measure the tension or pulling force on the tether 250 from the participating user athletes. Generally, the force sensor 260 will comprise a single or multi-axis load cell in operable communication with the controller 90 and control system 210 such that force feedback data is transmitted to the controller and processor for processing. Direction of force, tension values, average and instantaneous force magnitude values, and like measurements can be taken from the at least one sensor and combined during processing with the displacement of the belt 36 to provide enhanced control and feedback by the program 210. For instance, functional power can be calculated as a product of force in a specific direction on the sensor 260 and the displacement of the belt 36 and/or dummy 18, divided by the time of execution. This power function can provide data on average power, impact power, maximum power, minimum power, and reduction in power.

Figure 35:
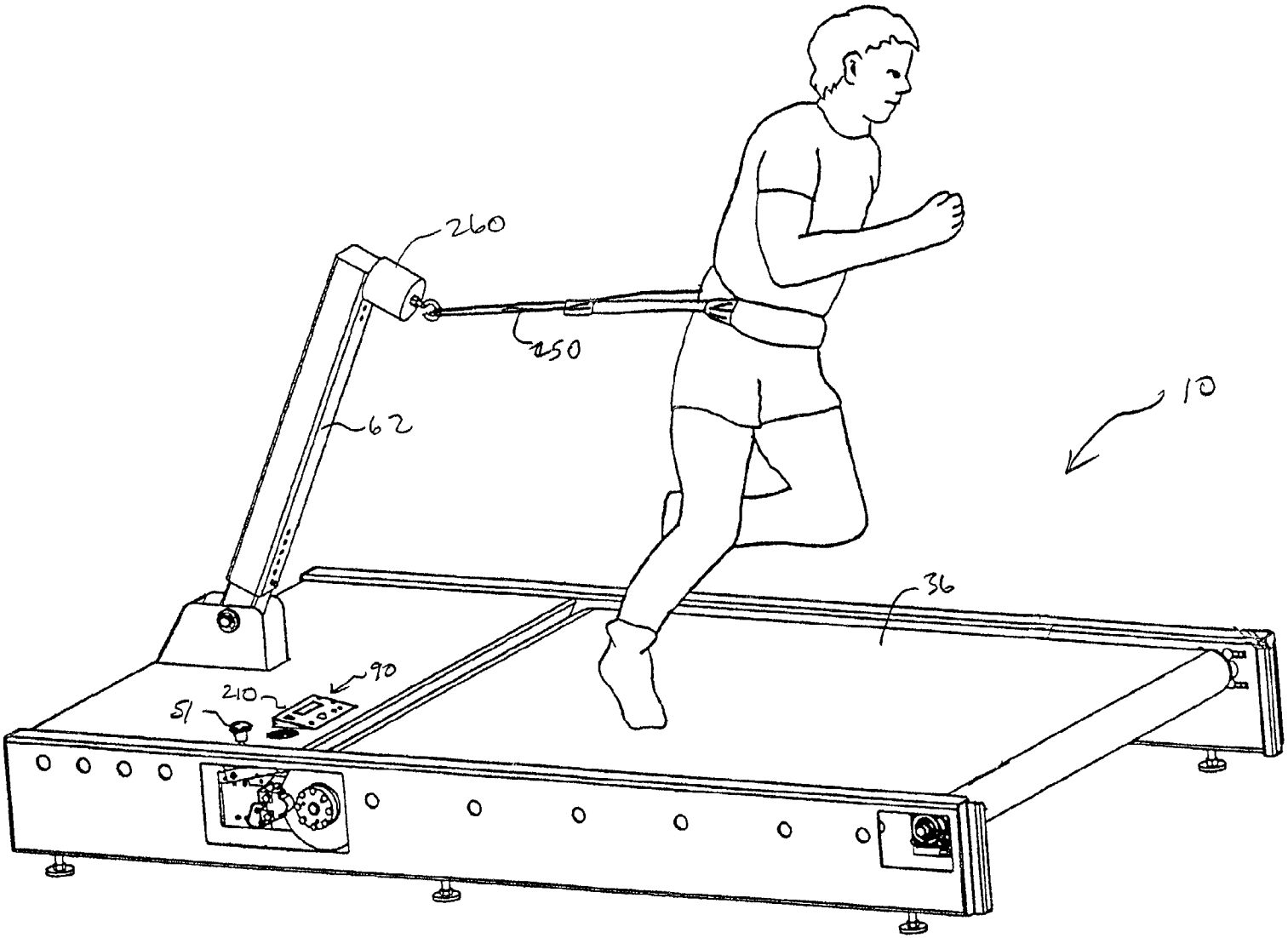
FIG. 35 is a perspective view of an embodiment of the present invention for sprint training.

During sprinting in particular, the at least one cell 260 assists in calculating magnitude and direction measurements that can be used to process and analyze work and power for the sprinter using the inertial reference frame of the present invention 10, as shown in FIG. 35.

Referring again to FIG. 30, a static dissipater 262 is shown. In one embodiment of the static dissipater 262, at least one strand of dissipating material, such as copper, is selectively configured to come into contact with a portion of the belt 36. This at least one strand is in turn grounded to the frame or other apparatus such that static buildup on the belt is discharged through to ground to protect the electronics of the invention 10 from being damaged. Generally, the static will thus dissipate through the frame's ground to an electricity source (not shown) such as a wall plug-in unit. Each of the embodiments of the invention disclosed herein can employ this static dissipater 262. In addition, other techniques, apparatus, and methods understood to one skilled in the art for dissipating static away from such a device can also be employed without deviating from the spirit and scope of the present invention.

Automated Control and Assessment System

Generally, the performance measurement system 22 of the present invention includes a versatile re-programmable automated control and assessment system program 210 running on a microprocessor and/or other circuitry components within the controller 22, 90. Each of the above-described apparatus and embodiments for the treadmill sled 10 can implement the automated program 210 described below as either individually isolated systems, or as a distributive or cooperative networked system of a plurality of embodiments or treadmill sled stations 212. Each station 212 is capable of being configured as any of the apparatus and unit embodiments described herein and can be in operable communication with the other stations and their respective automated programs 210.

Figure 36:
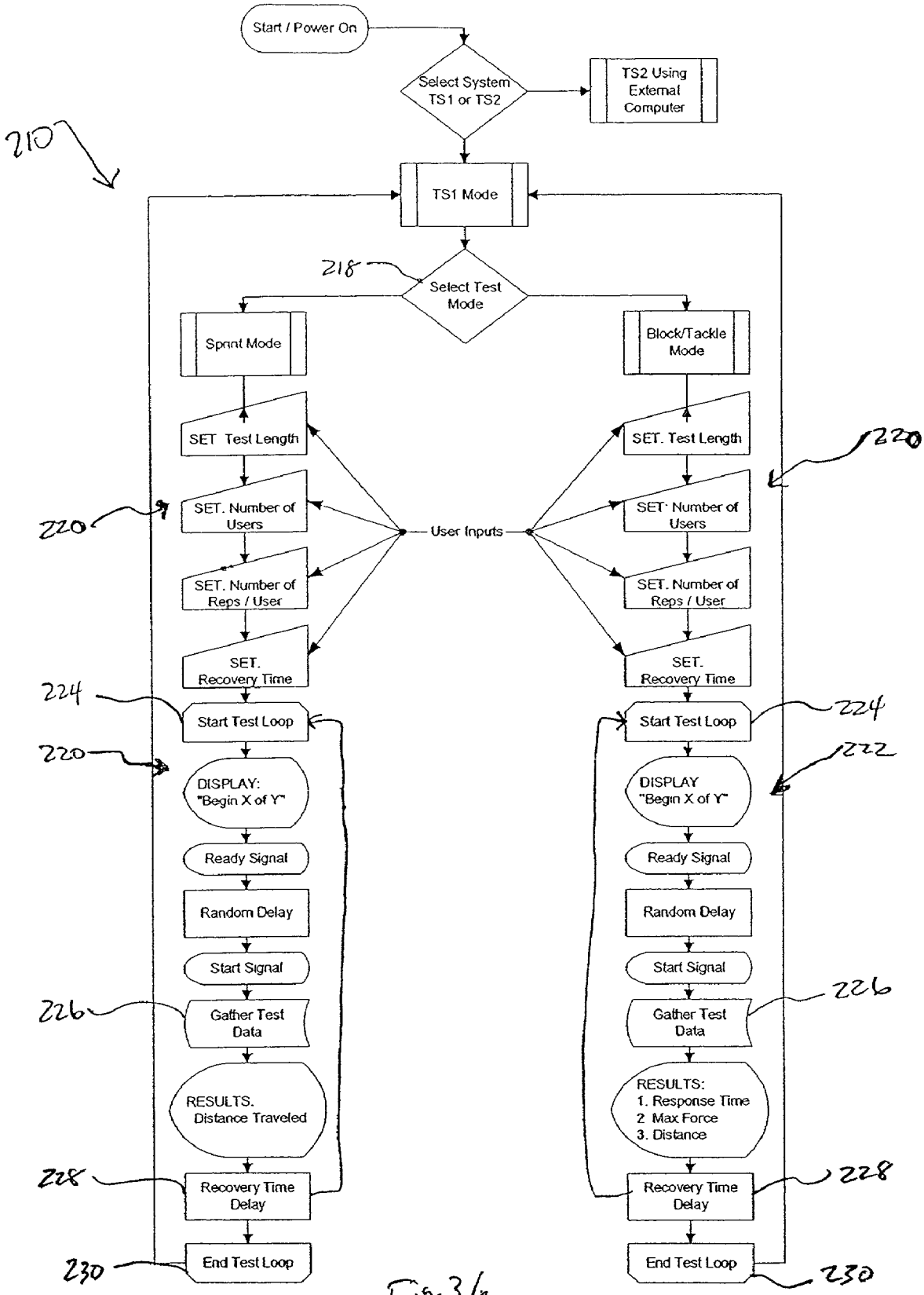
FIG. 36 is a schematic diagram of the program for an embodiment of the automated control and assessment system in accordance with the present invention.

Referring to FIG. 36, an embodiment of the program 210 is shown. The program 210 generally comprises a series of steps or routines. These steps can include a user identity step 216, a mode selection step 218, a training parameter step 220, and a training duration step 222. The training duration step 222 can further include a start loop step 224, a training work step 226, a resting/recovery period step 228, and an end training step 230. Each of these steps are indicative of general periods of input, control, and analysis for the program 210, but various training specific steps and procedures can be implemented at each level to create a highly programmable and flexible program.

The program 210 operates to trigger work 226 and rest 228 intervals for a single athlete or a plurality of athletes such that specific gaming and other real-life timing and conditioning patterns can be simulated. After completion of a training regimen, or a plurality of regimens, at least one athlete is able to download, or visually observe the performance statistics and evaluations derived from the controlled training session.

The user athlete is generally required to input user information 216 into the controller 90. This permits the controller to cross-compare with other athletes, restore and consider the individuals previous workouts, or future workout goals, and to provide the information needed to save the specific data for the upcoming training session. The user athlete can input the user information through a key pad, or through the use of a swippable card having magnetically stored information. In addition, other input techniques, devices, and methods known to one skilled in the art can also be employed without deviating from the spirit and scope of the present invention.

For an embodiment of the program 210 running on the controller 90 of the sprint and blocking embodiments of the present invention 10, the user is next required to input the test or training mode 218 of the upcoming training session. Alternatively, the specific requirements, simulation goals, and mode requirements can be uploaded to the controller 90 via the networked system described below. Other described and understood exercise modes can also be implemented in various combinations.

For a the parameter selection 218, the program 210 will generally require parameter settings 220 for test length, the number of users for the session, the number of repetitions per user, and the recovery time required for each. Again, these parameters can be inputted manually by the user, obtained from information on the user's magnetic card, or from the networked system. In addition to these parameters, other relevant parameters for enhancing the productivity and effectiveness of the present invention 10 can be utilized as well. For instance, the program 210 can output a minimum resting period for each repetition, and allow the user to make adjustments. Further, such adjustments can be eliminated by pre-programmed input settings by supervisory personnel.

With the aforementioned parameters configured within the program 210, the controller 90 will generally initiate a start sequence 224 which can involve the implementation of an auditory trigger signal to begin the session along with visual indicia of the initiation of the session on the readout 96. The audible trigger signal can be various beep combinations, voice plays, and the like. The visual indicia will generally include a detailed list for each athlete. For instance, a prompt for "user1" may indicate for that user to begin repetition X of Y. In addition, data for each of the users may be visually indicated on the readout 96 with potential comparison graphs and progress data summaries provided as well. Preferably, the ready signal or trigger will be followed by a random delay to prevent the user from obtaining unfair timing advantages based on past experience.

Once the particular repetition for a specific user is initiated at the work step 226, the controller 90 begins to retrieve data as detailed in each of the sprinting systems described herein. For instance, repetition specific traveling distances, and aggregate traveling distances, can be displayed on the readout 96 from the sprint mode regimen. Further, response time, max force, and distance can be outputted for the readout 96 in the block/tackle mode regimen. Upon completion of the user specific repetition, the rest period 228 is initiated, wherein an individual user can rest and prepare for the next repetition. In multi-user embodiments, each individual user can complete their designated workout periods and respective rest periods 228 before the controller 90 will prompt the positioning of the next user. Alternatively, the next user can position for their repetition at each user rest period. Other variations on these configurations are also envisioned.

If further repetitions are required, the program 210 will loop back to the initiation of the start sequence 224. This process will loop back until each of the repetitions for each of the applicable user athletes are completed. Upon completion, the end training step 230 is initiated wherein summary data can be displayed and saved for each of the athletes. For instance, distance traveled for each repetition and the aggregate training session can be displayed. Further, it is possible to calculate and display average improvement through the repetitions, comparisons to other user athlete performances, comparisons between the current distance performance and previous stored performances, current performance in view of the overall performance goals set, and a myriad of other relevant training summaries. Other calculations and data manipulations are also anticipated. This computed data and visual information can be merely displayed, or it can be transmitted or stored for future evaluation and use. For instance, the controller 90 can include a data storage device 214 such a computer disk drive, ZIP drive, writable CD, and the like. Moreover, the data can be transmitted through the network system described herein for still more computations and manipulation. In addition, the training data can be uploaded to other autonomous work stations through their respective controllers 90 by way of the data storage device 214 such that autonomous stations can still receive relevant workout parameters and other user data from previous workouts at other stations.

Specific embodiments of the present invention will be linked together using various understood networking topologies. For instance, each of the controllers 90 for the individual training stations or embodiments can be linked via cabling, RF transceivers, and the like. Preferably, each of the controllers 90 can include a network card that is linked to at least one central server such that the inputted and generated data at each station is capable of being shared and utilized by other stations and evaluated and manipulated by supervisory personnel at the central server. In such an embodiment, the user can complete the described training at a first station, and then proceed on to a second station, wherein the second station continues a long term broad training program taking into account the various performance statistics from the previous workouts, training modifications from supervisory personnel at the server, fixed training goals for each station, and a myriad of other shared variables and data.

It will be obvious to those skilled in the art that other embodiments in addition to the ones described herein are indicated to be within the scope and breadth of the present application. Accordingly, the applicant intends to be limited only by the claims appended hereto

What is claimed is:

1. A treadmill sled for controlling and assessing a training regimen for a plurality of user athletes, comprising:

a frame;

a rotatable continuous belt mounted on the frame, the belt presenting an upward directed support surface for supporting at least one of the plurality of user athletes;

a user athlete training apparatus supported proximate the continuous belt and being operably coupled to the frame by a support;

a blocking dummy operably coupled to the user athlete training apparatus, the blocking dummy comprising a potentiometer sensor for sensing compression from the at least one of the plurality of user athletes against the blocking dummy; and a programmable automated control and assessment system, the system having a processor adapted to process training parameter settings to control the training regimen for the plurality of user athletes, the parameter settings defining at least the number of repetitions for the plurality of user athletes and the resting periods between repetitions for the plurality of user athletes, the processor operably coupled with the belt to retrieve data to measure the at least one user athlete's distance traveled, wherein the automated control and assessment system further measures the response time of at least one of the plurality of user athletes against the blocking dummy and the maximum force against the blocking dummy by the at least one of the plurality of user athletes.

2. The treadmill sled of claim 1 wherein the automated control and assessment system receives the values of the potentiometer sensor and calculates the height of the impact and the magnitude of the impact force against the blocking dummy by the at least one of the plurality of user athletes.

3. The treadmill sled of claim 1 including a load cell sensor capable of sensing force direction and force magnitude on the user athlete training apparatus by at least one of the plurality of user athletes.

4. The treadmill sled of claim 1 further comprising a looped tether strap, the looped tether strap capable of being secured to the user athlete training apparatus at one end and capable of looping around at least one of the plurality of user athletes at the opposite end, wherein the looped tether strap restricts forward movement of the at least one of the plurality of user athletes on the belt during a sprint training regimen.

5. The treadmill sled of claim 4 including a load cell sensor capable of sensing force direction and force magnitude on the user athlete training apparatus by the at least one of the plurality of user athletes.

6. The treadmill sled of claim 1 wherein the automated control and assessment system includes a force sensor communicatively coupled to the processor, the force sensor measuring elongation of a biasing member, the elongation being responsive to a force exerted by at least one of the plurality of user athletes on the blocking dummy.

7. The treadmill sled of claim 1 wherein the user athlete training apparatus includes an offset support beam, with the offset support beam increasing at least one of the plurality of user athlete's usable space on the belt.

8. The treadmill sled of claim 1 further including a brake operably coupled to the continuous belt, the brake imparting a selectively variable resistance to a rotating motion of the continuous belt.

9. The treadmill sled of claim 1 wherein a plurality of automated control and assessment systems are in operable distributive communication with each other.

10. The treadmill sled of claim 1 further including a static dissipater in operable communication with the continuous belt.

11. A treadmill sled for controlling and assessing the training regimen for a plurality of user athletes, comprising:

a frame;

a rotatable continuous belt means mounted on the frame, the belt presenting an upward directed support surface for supporting at least one of the plurality of user athletes, a training means supported proximate the continuous belt and being operably coupled to the frame;

a blocking dummy means operably connected to the frame by a support means; and a programmable automated control and assessment system, the system having processing means for processing training parameter settings to control the training regimen for the plurality of user athletes, the parameter settings defining at least the number of repetitions for the plurality of user athletes and the resting periods between repetitions for the plurality of user athletes, the processing means operably coupled with the belt to retrieve data to the at least one user athlete's distance traveled, wherein the blocking dummy means further includes a potentiometer sensing means to measure the magnitude of the impact force against the blocking dummy means by at least one of the plurality of user athletes.

12. The treadmill sled of claim 11 wherein the training means includes a tether support frame means operably connected to the frame.

13. The treadmill sled of claim 11 further including friction resistance means operably connected to the belt means, the friction resistance means imparting a selectively variable resistance to the rotating motion of the belt means.

14. The treadmill sled of claim 11 wherein the automated control and assessment system receives the values of the potentiometer sensing means and calculates the height of the impact and the magnitude of the impact force against the blocking dummy by at least one of the plurality of user athletes.

15. The treadmill sled of claim 11 wherein the blocking dummy means is capable of receiving an end portion of a looped tether strap means, wherein the looped tether strap means is capable of looping around the at least one user athlete to restrict forward movement of at least one of the plurality of user athletes on the belt means during a sprint training regimen.

16. The treadmill sled of claim 11 wherein the automated control and assessment system measures the response time of the at least one of the plurality of user athlete's impact against the blocking dummy means.

17. The treadmill sled of claim 11 wherein the automated control and assessment system measures the displacement of the belt means to determine the total distance traveled by at least one of the plurality of user athletes during the training regimen.

18. The treadmill sled of claim 11 further including a load cell sensor capable of sensing force direction and force magnitude on the blocking dummy means by at least one of the plurality of user athletes.

19. The treadmill sled of claim 12 wherein the tether support frame means is capable of receiving an end portion of a looped tether strap means, wherein the looped tether strap means is capable of looping around at least one of the plurality of user athletes to restrict forward movement of the at least one athlete on the belt means during a sprint training regimen.

20. The treadmill sled of claim 19 wherein the automated control and assessment system measures the displacement of the belt means to determine the total distance traveled by the at least one of the plurality of user athletes during the sprint training regimen.

21. The treadmill sled of claim 12 further including a load cell sensor capable of sensing force direction and force magnitude on the a tether support frame means by at least one of the plurality of user athletes.

22. The treadmill sled of claim 11 further including a static dissipation means for dissipating static away from the treadmill sled.

* * * * *